US007150263B2

(12) United States Patent
Kishi et al.

(10) Patent No.: US 7,150,263 B2
(45) Date of Patent: Dec. 19, 2006

(54) ENGINE SPEED CONTROL APPARATUS; ENGINE SYSTEM, VEHICLE AND ENGINE GENERATOR EACH HAVING THE ENGINE SPEED CONTROL APPARATUS; AND ENGINE SPEED CONTROL METHOD

(75) Inventors: Tomoaki Kishi, Shizuoka (JP); Mikiyasu Uchiyama, Shizuoka (JP)

(73) Assignee: Yamaha Hatsudoki Kabushiki Kaisha, Shizuoka-ken (JP)

( * ) Notice: Subject to any disclaimer, the term of this patent is extended or adjusted under 35 U.S.C. 154(b) by 168 days.

(21) Appl. No.: 11/021,850

(22) Filed: Dec. 22, 2004

(65) Prior Publication Data

US 2005/0161022 A1 Jul. 28, 2005

(30) Foreign Application Priority Data

Dec. 26, 2003 (JP) ..... 2003-435017

(51) Int. Cl.
*F02D 1/00* (2006.01)
*F02D 41/00* (2006.01)

(52) U.S. Cl. ..... 123/319; 123/339.1

(58) Field of Classification Search ..... 123/319, 123/339.1, 376, 378, 391
See application file for complete search history.

(56) References Cited

U.S. PATENT DOCUMENTS 4,344,398 A * 8/1982 Ikeura ..... 123/339.22
4,345,557 A * 8/1982 Ikeura ..... 477/111
4,406,261 A * 9/1983 Ikeura ..... 477/111
4,545,348 A * 10/1985 Ikeura ..... 477/111
4,633,093 A * 12/1986 Otobe et al. ..... 290/40 R
4,649,878 A * 3/1987 Otobe et al. ..... 123/339.18
4,803,637 A * 2/1989 Tada et al. ..... 701/93
4,814,991 A * 3/1989 Tada et al. ..... 701/93
5,113,347 A * 5/1992 Ohuchi et al. ..... 701/113

FOREIGN PATENT DOCUMENTS

| | | |
|---|---|---|
| JP | 60-017254 | 1/1985 |
| JP | 05-86937 | 4/1993 |
| JP | 05-263703 | 10/1993 |
| JP | 09-79083 | 3/1997 |
| JP | 10-103121 | 4/1998 |
| JP | 2002-54485 | 2/2002 |

* cited by examiner

*Primary Examiner*—John T. Kwon
(74) *Attorney, Agent, or Firm*—Keating & Bennett, LLP

(57) ABSTRACT

An engine speed control apparatus includes a throttle valve for adjusting the amount of an intake air sucked into an engine, a drive unit for driving the throttle valve, and a control unit for generating a PWM signal for driving the drive unit. The control unit includes a real speed detecting unit for detecting a real engine speed, a target speed setting unit for setting a target engine speed, a target speed change amount calculating unit for calculating a target engine speed change amount with the use of the real engine speed and the target engine speed, and a PWM pulse generating unit which calculates, according to the target engine speed change amount, a PWM control parameter for determining a PWM duty, and generates a PWM signal based on the calculated PWM control parameter, so as to supply the generated PWM signal to the drive unit. The PWM control parameter includes at least one of a PWM duty correction value for correcting the duty ratio of a PWM signal, a PWM duty correction value maintaining time during which the PWM duty correction value is continuously applied, and a PWM duty correction frequency at which the PWM duty correction value is applied.

20 Claims, 21 Drawing Sheets

$n_{pwm} = INT(h_1a|\Delta N^*| + h_1b)$

INT() : ROUND DOWN DECIMALS OF VALUE IN ( )

$\Delta duty = h_2a(\Delta N^*) + h_2b)$ $t_{pwm} = h_3a|\Delta N^*| + h_3b)$

ENGINE SPEED CONTROL APPARATUS; ENGINE SYSTEM, VEHICLE AND ENGINE GENERATOR EACH HAVING THE ENGINE SPEED CONTROL APPARATUS; AND ENGINE SPEED CONTROL METHOD

BACKGROUND OF THE INVENTION

1. Field of the Invention

The present invention relates to an engine speed control apparatus and an engine speed control method for controlling an engine speed. Further, the present invention relates to an engine system having such an engine speed control apparatus, and also relates to a vehicle and an engine generator each having such an engine system.

2. Description of Related Art

The engine speed in an idling state is susceptible to influences of environmental conditions such as atmosphere and humidity, and is therefore unstable. Accordingly, an ISC (Idle Speed Control) control is conducted, at idling time, on a vehicle having an engine mounted thereon, particularly a two-wheeled motor vehicle.

A known ISC-control is disclosed in the Japanese Patent Laid-Open Publication (KOKAI) No. 5-263703. This prior art uses a throttle sensor for detecting the opening degree of a throttle valve (throttle opening degree) disposed in the main air intake passage of the engine. By controlling, to a target opening degree, the throttle opening degree detected by this throttle sensor, the idling engine speed is controlled.

In the idling engine speed zone, the engine speed is significantly changed by small changes in an intake air amount. It is therefore necessary to detect the throttle opening degree with high resolution (the throttle opening degree of about 0.02°) such that the throttle opening degree is precisely controlled.

For example, the throttle sensor has linear characteristics such that the output value thereof is 0V when the throttle opening degree is 0° and the output valve is 5V when the throttle opening degree is 90°.

When the output signal of the throttle sensor is analog/digital converted with an 8-bit A/D converter, for example, the throttle opening degree per bit is about 0.35°, thus failing to obtain sufficient resolution.

Accordingly, in the prior art of the Japanese Patent Laid-Open Publication (KOKAI) No. 5-263703, an output signal of a throttle sensor is amplified by an amplifier and then input into an A/D converter to improve the throttle opening degree detection resolution in the low opening degree zone.

However, this prior art requires an amplifier for enhancing the throttle opening degree detecting resolution, which disadvantageously increases the cost.

SUMMARY OF THE INVENTION

In order to overcome the problems described above, preferred embodiments of the present invention provide an engine speed control apparatus and an engine speed control method which precisely control an engine speed with a simple and economical structure.

Other preferred embodiments of the present invention provide an engine system having an engine speed control apparatus which precisely controls an engine speed with a simple and economical structure.

Further preferred embodiments of the present invention provide a vehicle having an engine system that precisely controls an engine speed with a simple and economical structure.

Still other preferred embodiments of the present invention provide an engine generator having an engine system that precisely controls an engine speed with a simple and economical structure.

An engine speed control apparatus according to a preferred embodiment of the present invention includes a throttle valve that is arranged to adjust the amount of an intake air sucked into an engine, a drive unit that is arranged to drive the throttle valve, and a control unit that is arranged to generate a PWM signal for driving the drive unit. The control unit includes a real speed detecting unit that is arranged to detect a real engine speed, a target speed setting unit that is arranged to set a target engine speed, a target speed change amount calculating unit that is arranged to calculate a target engine speed change amount with the use of both the real engine speed detected by the real speed detecting unit and the target engine speed set by the target speed setting unit, and a PWM pulse generating unit that is arranged to calculate a PWM parameter according to the target engine speed change amount calculated by the target speed change amount calculating unit, and generate a PWM signal based on the calculated PWM control parameter to supply the generated PWM signal to the drive unit. The PWM control parameter includes at least one of a PWM duty correction value for correcting the duty ratio of the PWM signal, a PWM duty correction value maintaining time during which the PWM duty correction value is continuously applied, and a PWM duty correction frequency at which the PWM duty correction value is applied.

According to the unique arrangement described above, a PWM control parameter including at least one of a PWM duty correction frequency, a PWM duty correction value, and a PWM duty correction value maintaining time is calculated according to the target engine speed change amount. The drive unit for driving the throttle valve is PWM-controlled based on the PWM control parameter. Therefore, the opening degree of the throttle valve is precisely controlled by a feedforward control according to the target engine speed change amount, and not by a feedback control based on the detection result of the throttle opening degree. Thus, the real engine speed is maintained close to the target engine speed. Further, the engine speed, particularly the idle speed requiring a fine control, is controlled with a simple and economical structure. This enables the engine speed to be finely controlled without the need for an amplifier for increasing the input resolution of the throttle sensor.

Preferably, the initial value of the PWM control parameter is set in the PWM pulse generating unit. In this case, the initial value is preferably set such that a driving force minimally required for exceeding a static friction force which prevents the throttle valve from being displaced, is supplied to the throttle valve from the drive unit.

According to the unique arrangement described above, a displacement of the throttle valve is produced by supplying a PWM signal with the use of the PWM control parameter initial value. This enables the real engine speed to be adjusted to be very close to the target engine speed. In particular, even at the time of idle speed control, the throttle valve can be opened/closed, as targeted, from the stationary state.

The PWM pulse generating unit can calculate the PWM control parameter by a function of the target engine speed change amount.

According to the unique arrangement described above, since the PWM control parameter is calculated with the use of a function corresponding to the target engine speed change amount, the PWM control parameter can be quickly calculated from the target engine speed change amount.

The PWM pulse generating unit can calculate the PWM control parameter with the use of a function of both the target engine speed change amount calculated by the target speed change amount calculating unit and the real engine speed detected by the real speed detecting unit.

Accordingly, the PWM control parameter can be determined more precisely with not only the target engine speed change amount, but also the real engine speed taken into consideration.

The PWM pulse generating unit preferably includes a first control signal calculating unit that is arranged to calculate the PWM control parameter according to the target engine speed change amount calculated by the target speed change amount calculating unit, and is arranged to calculate, a first control signal for PWM-controlling the drive unit according to the calculated PWM control parameter, and a signal generating unit that is arranged to generate the PWM signal to be supplied to the drive unit.

The engine speed control apparatus preferably further includes a throttle opening degree detecting unit that is arranged to detect a throttle opening degree which is the opening degree of the throttle valve, a target throttle opening degree change amount calculating unit that is arranged to calculate a target throttle opening degree change amount from the target engine speed change amount calculated by the target speed change amount calculating unit, a target throttle opening degree calculating unit that is arranged to calculate a target throttle opening degree with the use of both the target throttle opening degree change amount and the real throttle opening degree detected by the throttle opening degree detecting unit, a second control signal calculating unit that is arranged to calculate a second control signal for PWM-controlling the drive unit such that the real throttle opening degree detected by the throttle opening degree detecting unit is brought close to the target throttle opening degree calculated by the target throttle opening degree calculating unit, and a selecting unit that is arranged to select one of the first control signal and the second control signal based on the target throttle opening degree change amount calculated by the target throttle opening degree change amount calculating unit, and is arranged to supply the first or second control signal thus selected to the signal generating unit. In such a case, the signal generating unit may be arranged to generate the PWM signal based on the control signal supplied from the selecting unit.

According to the unique arrangement described above, a feedback control of PWM-controlling the drive unit based on the throttle opening degree, and a feedforward control of PWM-controlling the drive unit based on the target engine speed change amount are preferably provided and arranged to be switched from one to the other. Thus, a control suitable to the given situation can be executed. It is therefore possible to strike a balance between a high-speed response, to be achieved by a feedback control, required for greatly changing the throttle opening degree, and a highly precise control required for finely changing the throttle opening degree.

More specifically, the selecting unit is preferably arranged to select and supply the first control signal to the signal generating unit when the target throttle opening degree change amount calculated by the target throttle opening degree change amount calculating unit is not greater than a selection judgment value previously determined based on the input resolution of the throttle opening degree detecting unit, and the selecting unit is preferably arranged to select and supply the second control signal to the signal generating unit when the target throttle opening degree change amount calculated by the target throttle opening degree change amount calculating unit, is greater than the selection judgment value.

The selection judgment value maybe determined as a value substantially equal to the input resolution of the throttle opening degree detecting unit.

For example, it is now assumed that the selection judgment value is determined as a value substantially equal to the input resolution of the throttle opening degree detecting unit. When the target throttle opening degree change amount is less than the input resolution of the throttle opening degree detecting unit, the selecting unit selects the first control signal supplied from the first control signal calculating unit and drives the drive unit through the signal generating unit. On the other hand, when the target throttle opening degree change amount is greater than the input resolution of the throttle opening degree detecting unit, the selecting unit selects the second control signal and drives the drive unit through the signal generating unit. Thus, an engine speed control suitable to the situation is executed.

More specifically, the first control signal is selected to enable the engine speed to be finely controlled by a PWM pulse control. Further, when a fine engine speed control is not required, the second control signal is selected to conduct a position feedback control in which an engine speed control having a high response speed is executed.

The selecting unit may be arranged to supply the first control signal or the second control signal selected based on not only the target throttle opening degree change amount but also the real throttle opening degree detected by the throttle opening degree detecting unit. Accordingly, the first control signal or the second control signal may be properly selected.

An engine speed control apparatus according to a preferred embodiment of the present invention further includes an accelerator tracking target throttle opening degree calculating unit that is arranged to calculate a target throttle opening degree based on the accelerator opening degree, and a third control signal calculating unit that is arranged to calculate a third control signal for PWM-controlling the drive unit such that the real throttle opening degree detected by the throttle opening degree detecting unit is brought close to the target throttle opening degree calculated by the accelerator tracking target throttle opening degree calculating unit. This apparatus is preferably arranged such that the selecting unit selects one of the first control signal, the second control signal and the third control signal based on the real throttle opening degree detected by the throttle opening degree detecting unit and on the target throttle opening degree change amount calculated by the target throttle opening degree change amount calculating unit, and supplies the control signal thus selected to the signal generating unit.

According to the unique arrangement described above, one of the first control signal corresponding to the PWM control parameter according to the target engine speed change amount, the second control signal corresponding to the target engine speed change amount and the real throttle opening degree, and the third control signal corresponding to the accelerator opening degree is selected. It is therefore possible not only to conduct an idle speed control with high precision, but also to conduct an engine speed control which accurately tracks the accelerator opening degree instruction.

The apparatus is preferably arranged such that the selecting unit selects and supplies the third control signal when the real throttle opening degree detected by the throttle opening degree detecting unit is greater than a predetermined threshold, and such that the selecting unit selects and supplies one of the first control signal, the second control signal and the third control signal according to the target throttle opening degree change amount calculated by the target throttle opening degree change amount calculating unit when the real throttle opening degree is not greater than the threshold.

According to the unique arrangement described above, when the real throttle opening degree is greater than the threshold, it is judged that the accelerator is under operation and the third control signal corresponding to the accelerator opening degree is therefore selected. It is therefore possible to execute an engine speed control that is very responsive to the accelerator operation. On the other hand, when the real throttle opening degree is relatively small, according to the target throttle opening degree change amount, a proper control signal out of the first, second and third control signals is selected.

More specifically, the selecting unit may be arranged to select the third control signal when the target throttle opening degree change amount is greater than a first selection judgment value, to select the second control signal when the target throttle opening degree change amount is in a range between the first selection judgment value and a second selection judgment value smaller than the first selection judgment value, and to select the first control signal when the target throttle opening degree change amount is not greater than the second selection judgment value.

The PWM pulse generating unit may execute, repeatedly at various time intervals, a PWM correction control in which a PWM signal corresponding to the PWM control parameter is supplied to the drive unit. In this case, the engine speed control apparatus preferably further includes a real speed change amount calculating unit that is arranged to calculate a real engine speed change amount using both the real engine speed detected by the real speed detecting unit before a PWM correction control and the real engine speed detected by the real speed detecting unit after the PWM correction control, and a changing unit that is arranged to change, using both the target engine speed change amount calculated by the target speed change amount calculating unit and the real engine speed change amount calculated by the real speed change amount calculating unit, the relationship between the target engine speed change amount and the PWM control parameter for the subsequent PWM correction controls that follow.

According to the unique arrangement described above, when the throttle opening degree cannot be changed as targeted with the PWM duty determined according to the previous PWM control parameter, the relationship (e.g., function) between the PWM control parameter and the target engine speed change amount is changed. Accordingly, the throttle opening degree is accurately changed upon and after the subsequent processing.

For example, the torque applied to the throttle valve driven by the drive unit is often not constant due to influences of the friction of the throttle valve shaft, gear backlash of the transmission mechanism of the throttle valve, the return spring and other factors. Accordingly, there are instances in which with the use of the initial value of the PWM control parameter alone, the throttle valve cannot sufficiently be displaced and the engine speed therefore cannot be controlled with high precision. In such a case, according to the unique arrangement described above, the real engine speed change amount is fed back such that the changing unit corrects the relationship between the PWM control parameter and the target engine speed change amount, thus enabling the throttle valve opening degree to be controlled as targeted.

The changing unit may be arranged such that the relationship between the target engine speed change amount and the PWM control parameter is changed in accordance with the real engine speed detected by the real speed detecting unit before the PWM correction control.

Further, the PWM pulse generating unit may execute the PWM correction control at predetermined control cycles.

Preferably, the changing unit changes the relationship of the PWM duty correction value with respect to the target engine speed change amount when the absolute value of the real engine speed change amount calculated by the real speed change amount calculating unit is substantially zero.

According to the unique arrangement described above, the changing unit changes the relationship of the PWM duty correction value with respect to the target engine speed change amount when the real engine speed change amount substantially undergoes no change. This securely causes the throttle valve to be displaced, thereby accurately controlling the engine speed. The case where the real engine speed change amount undergoes no change refers to the case where the throttle valve has not been substantially displaced. That is, the static friction torque is greater than the throttle-valve driving force of the drive unit, e.g., the motor-generated torque. In such a case, even though the PWM duty correction frequency or the PWM duty correction value maintaining time is changed, the drive force generated by the drive unit is not changed, and this is therefore ineffective. Accordingly, by correcting the relationship between the PWM duty correction value and the target engine speed change amount, the throttle valve is accurately driven.

Preferably, the changing unit changes the relationship of the PWM duty correction value maintaining time or the PWM duty correction frequency with respect to the target engine speed change amount when the absolute value of the real engine speed change amount calculated by the real speed change amount calculating unit, is not substantially zero, but the difference between the absolute value of the real engine speed change amount and the absolute value of the target engine speed change amount calculated by the target speed change amount calculating unit exceeds a predetermined threshold.

According to the unique arrangement described above, when the real engine speed change amount is not zero, but is substantially less than the target engine speed change amount, the changing unit changes the relationship between the PWM duty correction frequency or the PWM duty correction value maintaining time and the target engine speed change amount. This enables the engine speed to be controlled more precisely than in the case where the PWM duty correction value is corrected. It is a matter of course that the real engine speed change amount can also be changed by changing the PWM duty correction value. However, for example, when the PWM duty correction value is excessively large, there are instances in which the drive force (generated torque) generated at the drive unit such as a motor, becomes excessively large. This makes fine adjustment difficult.

When the initial value of the PWM duty correction value is set such that the drive force minimally required for moving the throttle valve, is generated by the drive unit, the fine adjustment of the throttle valve is performed more easily by changing the PWM duty correction frequency or the PWM duty correction value maintaining time while the PWM duty correction value is maintained unchanged.

An engine system according to a further preferred embodiment of the present invention includes an engine, and an engine speed control apparatus having the features described above.

A vehicle according to another preferred embodiment of the present invention includes the engine system described above, and a traveling wheel to be rotationally driven by a drive force generated by the engine. According to this arrangement, the engine speed particularly at the time of idling, is precisely controlled with an economical structure.

An engine generator according to yet another preferred embodiment of the present invention includes the engine system described above, and a generating unit to be operated by the engine serving as a drive source. According to this arrangement, the engine speed can precisely be stabilized, thus achieving a stable-output engine generator with an economical structure.

Another preferred embodiment of the present invention provides an engine speed control method of controlling an engine speed by driving a throttle valve with a drive unit to be driven by a PWM signal. This engine speed control method includes a real speed detecting step of detecting a real engine speed, a target speed setting step of setting a target engine speed, a target speed change amount calculating step of calculating a target engine speed change amount using both the detected real engine speed and the set target engine speed, a PWM control parameter calculating step of calculating a PWM control parameter for determining the duty of the PWM signal according to the calculated target engine speed change amount, and a PWM signal supplying step of generating a PWM signal based on the calculated PWM control parameter and of supplying the PWM signal thus generated to the drive unit. The PWM control parameter includes at least one of a PWM duty correction value for correcting the duty ratio of the PWM signal, a PWM duty correction value maintaining time during which the PWM duty correction value is continuously applied, and a PWM duty correction frequency at which the PWM duty correction value is applied.

According to the method described above, the PWM control parameter for determining the duty of the PWM signal is calculated based on the target engine speed change amount, and by a feedforward control of driving the throttle valve based on the calculated PWM control parameter, the throttle valve opening degree is precisely controlled. It is therefore possible to control, with a simple and economical structure, the engine speed, and particularly the idle speed requiring a fine control. Thus, the engine speed can be precisely controlled without the need for an amplifier for increasing the input resolution of a throttle sensor.

Preferably, the method described above further includes a step of setting the initial value of the PWM control parameter such that a driving force minimally required for exceeding a static friction force which prevents the throttle valve from being displaced is supplied to the throttle valve from the drive unit. Thus, the throttle valve can be accurately driven to securely cause the engine speed to be changed.

Preferably, the PWM control parameter calculating step is arranged such that the PWM control parameter is determined based not only on the target engine speed change amount but also on the real engine speed.

An engine speed control method according to a preferred embodiment of the present invention further includes a step of generating a first control signal based on the calculated PWM control parameter, a throttle opening degree detecting step of detecting a real throttle opening degree which is the opening degree of the throttle valve with a throttle opening degree detecting unit, a target throttle opening degree calculating step of calculating a target throttle opening degree using the target engine speed change amount and the detected real throttle opening degree, and a step of calculating a second control signal for PWM-controlling the drive unit such that the real throttle opening degree is brought close to the target throttle opening degree. The PWM signal supplying step includes a control signal selecting step of selecting one of the first control signal and the second control signal, and a step of generating a PWM signal based on the selected control signal and of supplying the generated PWM signal to the drive unit.

According to the method described above, a feedforward control based on the target engine speed change amount is combined with a feedback control based on the detected throttle opening degree, thus enabling the throttle opening degree to be more accurately controlled.

Preferably, the control signal selecting step includes a step of selecting the first control signal when the target throttle opening degree change amount corresponding to the target engine speed change amount is less than a selection judgment value previously determined based on the input resolution of the throttle opening degree detecting unit, and a step of selecting the second control signal when the target throttle opening degree change amount is greater than the selection judgment value.

This enables the control to be properly switched according to the input resolution of the throttle opening degree detecting unit, thus enabling the throttle opening degree to be more accurately controlled.

The engine speed control method described above preferably further includes a real speed change amount calculating step of calculating a real engine speed change amount with the use of the real engine speed detected before and after a PWM correction control in which a PWM signal corresponding to the PWM control parameter is supplied to the drive unit, and a step of changing, with the use of both the target engine speed change amount and the real engine speed change amount, the relationship between the target engine speed change amount and the PWM control parameter for all of the subsequent PWM correction controls that follow.

Thus, when the real engine speed change amount is too large or too small, the PWM control parameter setting mode can be corrected, thus enabling the engine speed to be accurately controlled.

The foregoing and other elements, features, steps, characteristics and advantages of the present invention will become more apparent from the following detailed description of preferred embodiments with reference to the attached drawings.

DETAILED DESCRIPTION OF PREFERRED EMBODIMENTS

First Preferred Embodiment

Figure 1:
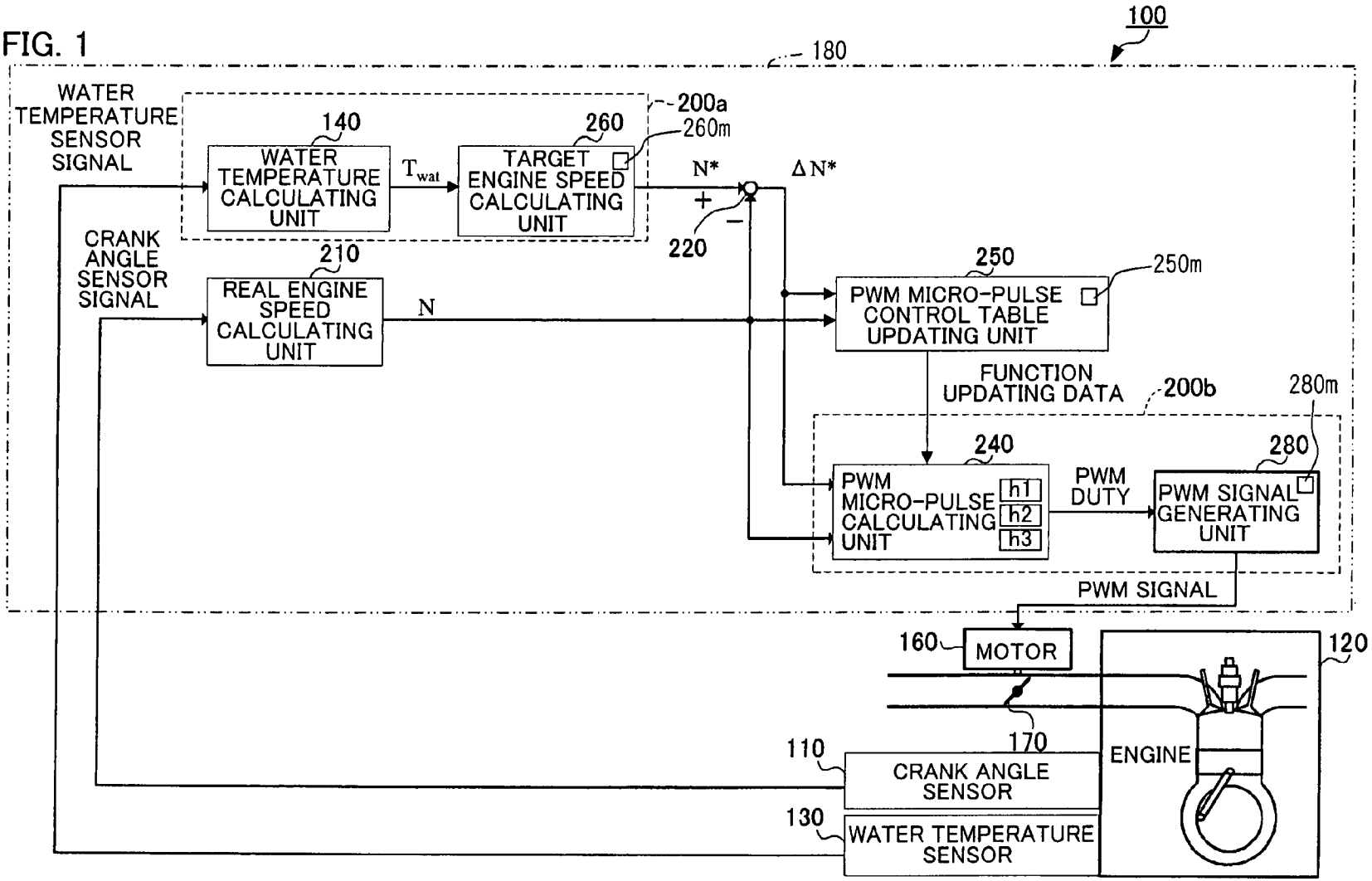
FIG. 1 is a block diagram illustrating the arrangement of an engine system according to a first preferred embodiment of the present invention.

FIG. 1 is a block diagram illustrating the arrangement of an engine system according to a first preferred embodiment of the present invention.

This engine system includes an engine (internal combustion engine) 120 and an engine speed control apparatus 100. This engine system is, for example, mounted on a vehicle in which the engine speed is controlled by adjusting the amount of intake air sucked into the engine by opening/closing an electronic throttle valve. This electronic throttle valve is PWM-controlled (in which PWM stands for Pulse Width Modulation). The engine speed control apparatus 100 of this preferred embodiment will be discussed with respect to an apparatus for controlling the engine speed of the engine 120, particularly the engine speed of the engine 120 in an idling state of the vehicle.

The engine speed control apparatus 100 includes a crank angle sensor 110, a water temperature sensor 130, a motor (drive unit) 160, a throttle valve 170, and a control unit 180. The control unit 180 is arranged to generate a PWM signal for driving the motor 160 to control the opening degree of the throttle valve 170 (throttle opening degree). The electronic throttle valve is thus constructed.

The control unit 180 includes a real engine speed calculating unit (real speed detecting unit) 210, a target speed setting unit 200*a*, a target engine speed change amount calculating unit (target speed change amount calculating unit) 220, a PWM micro-pulse control table updating unit (changing unit) 250 and a PWM pulse generating unit 200*b*.

The crank angle sensor 110 is arranged to detect the rotational angle of the crankshaft of the engine 120, and to supply the detected signal to the real engine speed calculating unit 210.

The real engine speed calculating unit 210 is arranged to calculate a real engine speed N based on the crank angle signal detected by the crank angle sensor 110, and to supply the calculated real engine speed N to the target engine speed change amount calculating unit 220, the PWM pulse generating unit 200*b* and the PWM micro-pulse control table updating unit 250.

The water temperature sensor 130 is arranged to detect the temperature of cooling water for cooling the engine 120 and to supply the detected water temperature to the target speed setting unit 200*a*. The target speed setting unit 200*a* includes a water temperature calculating unit 140 and a target engine speed calculating unit 260.

The water temperature calculating unit 140 is arranged to calculate a water temperature $T_{wat}$ based on a water temperature sensor signal input from the water temperature sensor 130.

The target engine speed calculating unit 260 is arranged to calculate a target engine speed N* based on the water temperature $T_{wat}$ input from the water temperature calculating unit 140, and to supply the calculated target engine speed N* to the target engine speed change amount calculating unit 220.

More specifically, the target engine speed calculating unit 260 includes a memory unit 260*m* which stores a function table containing data of the relationship between water temperature $T_{wat}$ and target engine speed N*.

Figure 2:
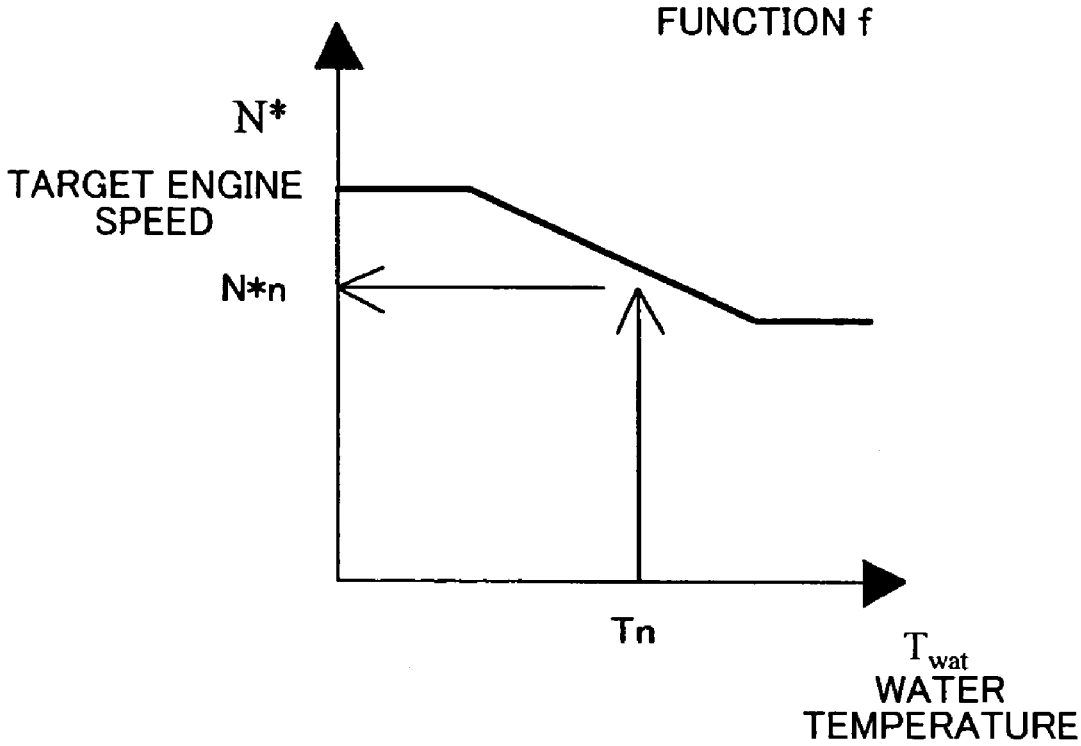
FIG. 2 is a view illustrating an example of a function table used for calculating a target engine speed.

FIG. 2 shows an example of the function table stored in the memory unit 260*m* of the target engine speed calculating unit 260.

As shown by Function Table f in FIG. 2, the target engine speed calculating unit 260 is arranged to calculate a target engine speed N*n corresponding to the input water temperature Tn and to supply the calculated target engine speed N*n to the target engine speed change amount calculating unit 220 and the PWM micro-pulse control table updating unit 250.

The target engine speed change amount calculating unit 220 includes a subtractor for determining a deviation (engine speed deviation) between the target engine speed N* calculated by the target engine speed calculating unit 260 and the real engine speed N calculated by the real engine speed calculating unit 210. In this preferred embodiment, the target engine speed change amount calculating unit 220 supplies the calculated engine speed deviation, in terms of a target engine speed change amount ΔN* (=N*−N). However, the target engine speed change amount calculating unit 220 may be arranged to further execute a predetermined operation on the engine speed deviation to obtain a target engine speed change amount ΔN*.

The target engine speed change amount calculating unit 220 is arranged to supply the calculated target engine speed change amount ΔN* to the PWM pulse generating unit 200*b* and the PWM micro-pulse control table updating unit 250.

The PWM pulse generating unit 200*b* has a PWM micro-pulse calculating unit 240 and a PWM signal generating unit 280. The PWM signal generating unit 280 is capable of generating a PWM signal for driving the motor 160 in the direction to open the throttle valve 170 (opening direction), a PWM signal for driving the motor 160 in the direction to close the throttle valve 170 (closing direction), and a PWM signal for maintaining the position of the throttle valve 170. More specifically, by supplying to the motor 160, for example, a PWM pulse having a predetermined retention duty ratio, the position of the throttle valve 170 is maintained, and the throttle opening degree is therefore maintained. Further, by supplying to the motor 160, for example, a PWM pulse having a duty ratio greater than the retention duty ratio described above, the motor 160 can be driven in the opening direction to increase the throttle opening degree. Further, by giving, to the motor 160, for example a PWM pulse of a duty ratio less than the retention duty ratio described above, the motor 160 can be driven in the closing direction to reduce the throttle opening degree. Any of a variety of known methods may be adopted as a method of controlling the motor 160 by a PWM signal.

On the other hand, the PWM micro-pulse calculating unit 240 is arranged to calculate parameters for a PWM micro-pulse control (PWM control parameters) based on the target engine speed change amount ΔN* calculated by the target engine speed change amount calculating unit 220 and the real engine speed N calculated by the real engine speed calculating unit 210. Further, the PWM micro-pulse calculating unit 240 supplies, to the PWM signal generating unit 280, a PWM duty (control signal) based on the calculated PWM control parameters.

Here, the PWM micro-pulse refers to each of the pulses forming a PWM pulse train. The PWM micro-pulse control refers to a control (PWM correction control) in which the PWM pulse of the retention duty ratio described above which is being supplied to the motor 160, is corrected to finely move the throttle valve 170.

The PWM micro-pulse calculating unit 240 includes function tables h1, h2, h3 to be used for determining the PWM control parameters. In this preferred embodiment, the PWM control parameters to be calculated according to the target engine speed change amount ΔN* and the real engine speed N, include a PWM duty correction frequency $n_{pwm}$, a PWM duty correction value Δduty and a PWM duty correction value maintaining time $t_{pwn}$. Accordingly, the function tables h1, h2, h3 are used to respectively generate, according to the input target engine speed change amount ΔN* and the input real engine speed N, the PWM duty correction frequency $n_{pwm}$, the PWM duty correction value Δduty and the PWM duty correction value maintaining time $t_{pwn}$.

The PWM micro-pulse calculating unit 240 obtains the duty ratio of a PWM micro-pulse based on the PWM duty correction frequency $n_{pwm}$, the PWM duty correction value Δduty and the PWM duty correction value maintaining time $t_{pwn}$, and then supplies this duty ratio as a control signal to the PWM signal generating unit 280.

Figure 3:
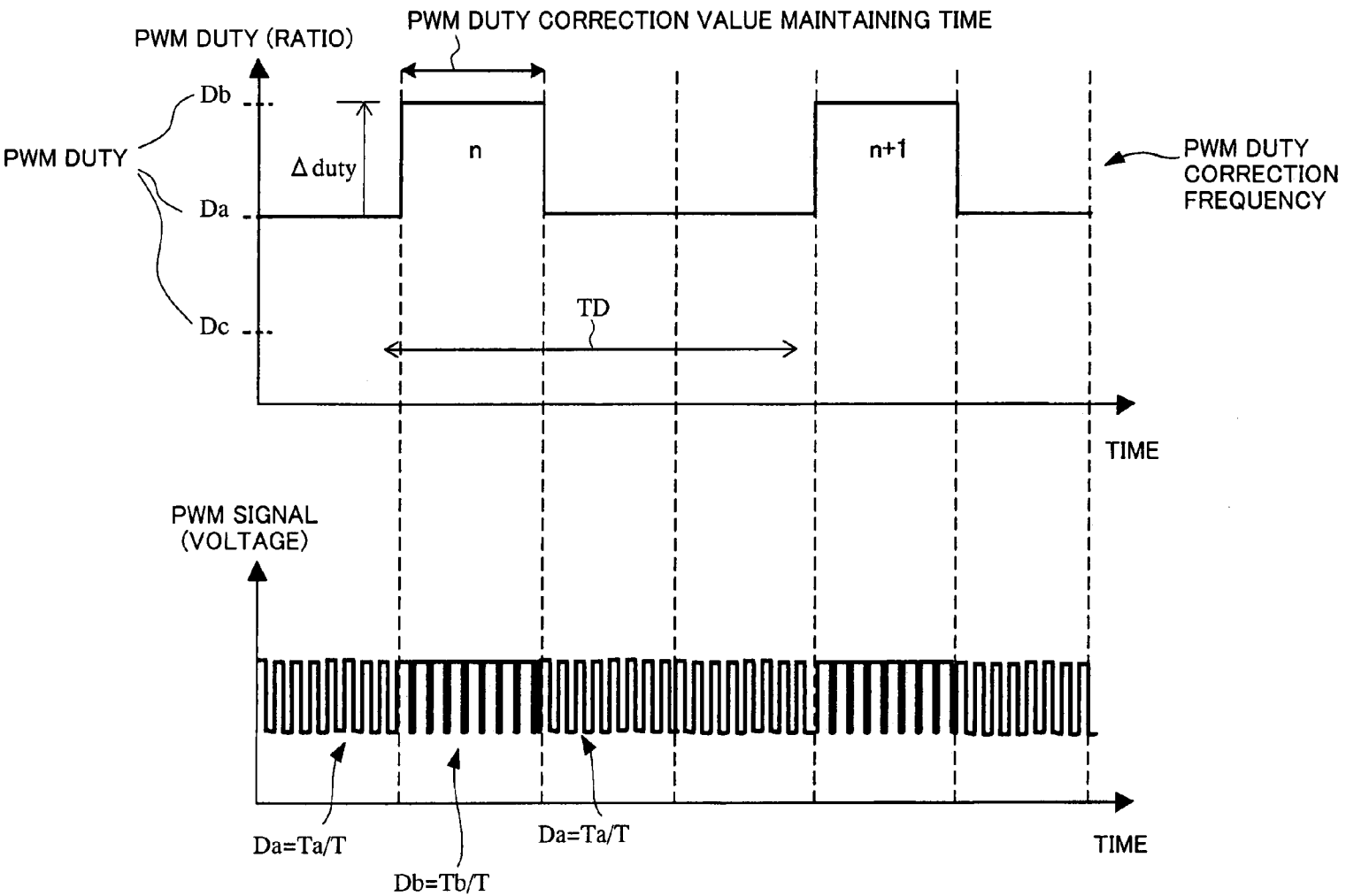
FIG. 3 is a view for explaining PWM control parameters to be used for a PWM micro-pulse control.

FIG. 3 is a view illustrating parameters at the time of PWM micro-pulse control. FIG. 3 shows an example in which the PWM duty correction frequency is twice. FIG. 3 also shows the PWM control parameters and PWM signals (voltages) corresponding thereto.

The PWM micro-pulse control is repeatedly conducted at predetermined control cycles. The PWM micro-pulse calculating unit 240 sets, at predetermined duty setting cycles TD in each control cycle, PWM duty values to the PWM signal generating unit 280, and the PWM signal generating unit 280 generates PWM signals of duty values corresponding to the PWM duty values.

For example, a PWM duty Da is a retention duty ratio (predetermined value) for maintaining the throttle opening degree, a PWM duty Db is an example of the duty ratio for driving the throttle valve 170 in the opening direction, and a PWM duty Dc is an example of the duty ratio for driving the throttle valve 170 in the closing direction. In this example, the deviation of the PWM duty Db, Dc from the PWM duty Da is the PWM duty correction value Δduty. The PWM duty correction value Δduty is positive when setting the PWM duty Db greater than the PWM duty Da, and the PWM duty correction value Δduty is negative when setting the PWM duty Dc smaller than the PWM duty Da.

In the example shown in FIG. 3, the PWM duty is increased from Da to Db twice at a time interval of duty setting cycle TD. That is, the PWM duty correction frequency $n_{pwm}$ is set to be "2" ($n_{pwm}$=2) which is the number of times the PWM duty correction value Δduty is applied. Further, provision is made such that the PWM duty Db is maintained for the PWM duty correction value maintaining time $t_{pwn}$ during which the PWM duty correction value Δduty is continuously applied.

Figure 4A:
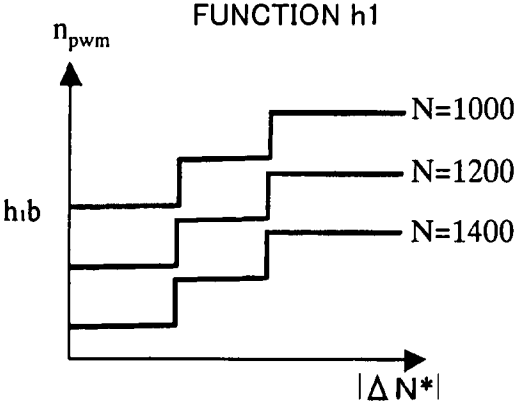
FIG. 4(*a*), FIG. 4(*b*) and FIG. 4(*c*) are views illustrating examples of function tables for calculating the PWM control parameters.
Figure 4B:
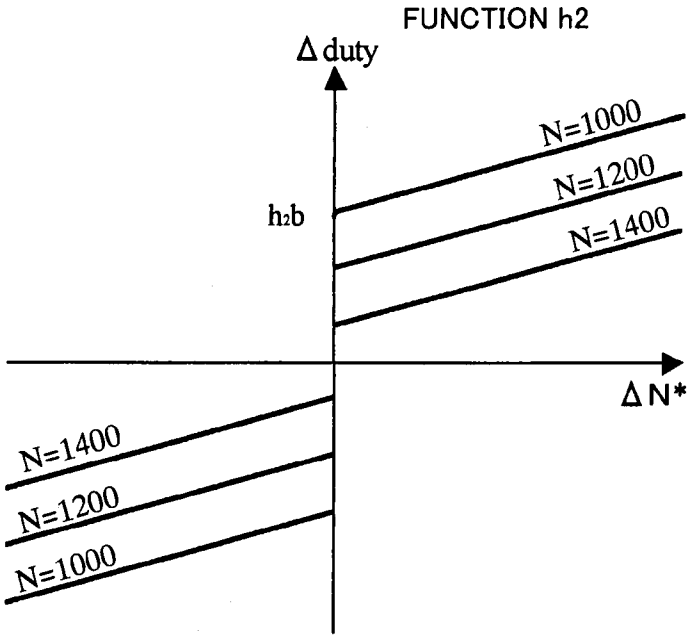
Figure 4C:
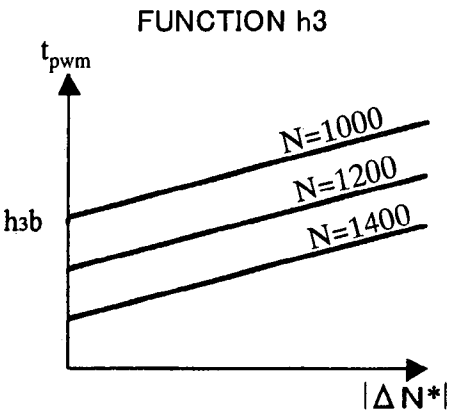

FIG. 4(*a*), FIG. 4(*b*) and FIG. 4(*c*) are views illustrating the relationships between the PWM control parameters and the target engine speed change amount. FIG. 4(*a*) shows a function table (function h1) illustrating the relationship between (i) the PWM duty correction frequency $n_{pwm}$, and (ii) the target engine speed change amount ΔN* and the real engine speed N. FIG. 4(*b*) shows a function table (function h2) illustrating the relationship between (i) the PWM duty correction value Δduty, and (ii) the target engine speed change amount ΔN* and the real engine speed N. Further, FIG. 4(*c*) shows a function table (function h3) illustrating the relationship between (i) the PWM duty correction value maintaining time $t_{pwn}$, and (ii) the target engine speed change amount ΔN* and the real engine speed N.

The function h1 shown in FIG. 4(*a*) is expressed as $n_{pwm}$=INT ($h_1a|\Delta N^*|+h_1b$) (wherein $h_1a$ and $h_1b$ are coefficients) , and the PWM duty correction frequency ($n_{pwm}$) appears in a discrete manner. At least one of the coefficients $h_1a$ , $h_1b$ ($h_1b$ in the example in FIG. 4(*a*)) is not a constant value, but varies with the real engine speed N.

The function h2 shown in FIG. 4(*b*) is expressed as $\Delta duty = h_2a(\Delta N^*) + h_2b$ (wherein $h_2a$ and $h_2b$ are coefficients) where $\Delta N > 0$, as $\Delta duty = 0$ where $\Delta N = 0$, and as $\Delta duty = h_2a(\Delta N^*) - h_2b$ where $\Delta N < 0$. The PWM duty correction value Δduty is continuously set with respect to the target engine speed change amount ΔN*. At least one of the coefficients $h_2a$, $h_2b$ ($h_2b$ in the example in FIG. 4(*b*)) is not a constant value, but varies with the real engine speed N.

In practice, the function table h2 contains only the PWM duty correction value Δduty for $\Delta N > 0$. For $\Delta N < 0$, the PWM duty is corrected with the use of a value obtained by adding a negative sign to the PWM duty correction value Δduty (value corresponding to $|\Delta N|$) stored in the function table h2.

The function h3 shown in FIG. 4(*c*) is expressed as $t_{pwm} = h_3a\,|\Delta N^*| + h_3b$ (wherein $h_3a$ and $h_3b$ are coefficients), and the PWM duty correction value maintaining time $t_{pwm}$ is continuously set with respect to the target engine speed change amount ΔN*. At least one of the coefficients $h_3a$, $h_3b$ ($h_3b$ in the example in FIG. 4(*c*)) is not a constant value, but varies with the real engine speed N.

As discussed later, the coefficients $h_1a$ , $h_2a$, $h_3a$, $h_1b$, $h_2b$, $h_3b$ which define the functions h1, h2, h3 shown in FIG. 4(*a*), FIG. 4(*b*) and FIG. 4(*c*), are variables and may be updated. These coefficients $h_1a$ , $h_2a$, $h_3a$, $h_1b$, $h_2b$, $h_3b$ are updated by the function updating data in the PWM micro-pulse control table updating unit 250.

The function tables hi, h2, h3 store only the function values for a plurality of predetermined engine speeds N (N=1000, 1200, 1400 in the example in FIG. 4(*a*)–FIG. 4(*c*)). For engine speeds N other than these values, the PWM control parameters may be obtained by performing an interpolation on function values stored in the function tables h1, h2, h3, or the function values for an engine speed approximated to the real engine speed may be used as the PWM control parameters.

The initial values of the PWM control parameters $n_{pwm}$, Δduty and $t_{pwm}$ are set in the PWM micro-pulse calculating unit 240. The initial values are set such that the driving motor 160 generates minimum required torque in a level exceeding the static friction torque applied to the motor 160.

Figure 5B:
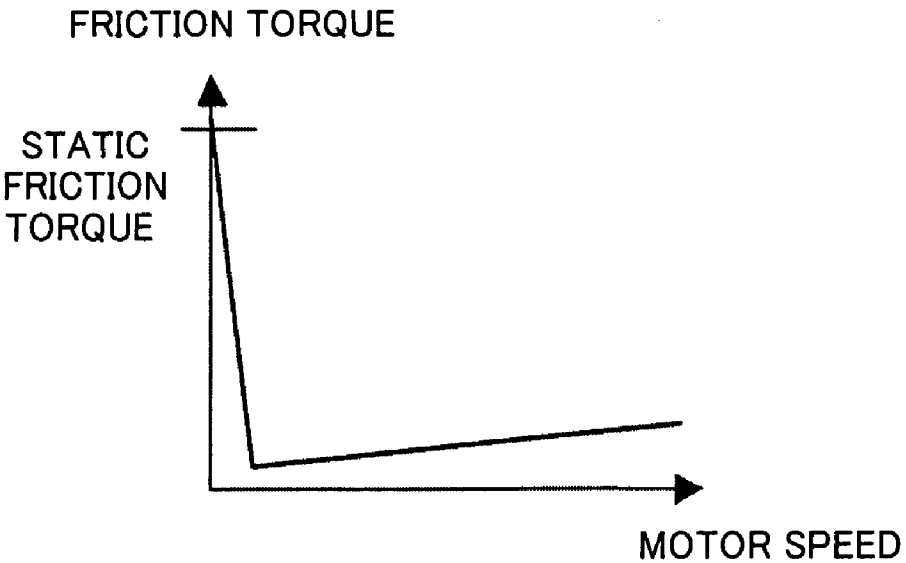
FIG. 5(*a*) is a schematic view illustrating the structure of a throttle valve, and FIG. 5(*b*) is a view showing a friction torque applied to a motor.
Figure 5A:
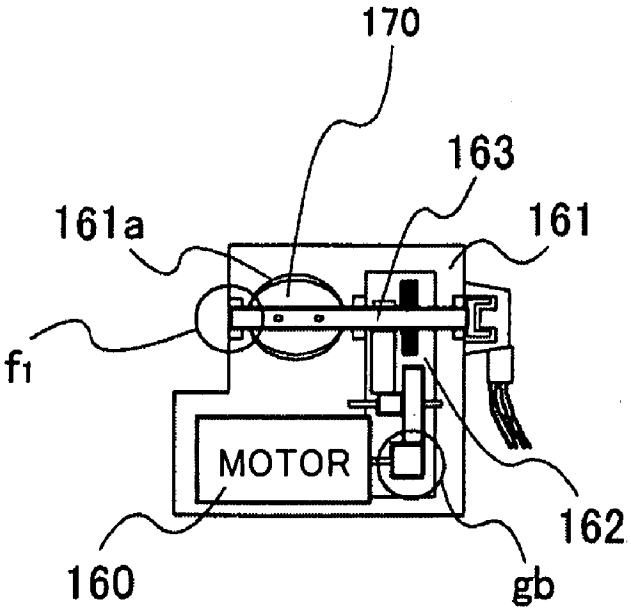

With reference to FIG. 5(*a*), FIG. 5(*b*) and FIG. 6(*a*)–FIG. 6(*d*), setting the initial values of the PWM control parameters $h_{pwm}$,Δduty and $t_{pwm}$ (more specifically, the initial values of the coefficients $h_1b$, $h_2b$, $h_3b$ of the functions h1, h2, h3) will be described.

FIG. 5(*a*) is a schematic view illustrating the structure of the throttle valve 170. FIG. 5(*b*) is a view illustrating the friction torque applied to the motor 160 shown in FIG. 5(*a*). As shown in FIG. 5(*a*), the motor 160 is disposed on a throttle body 161 connected to an air intake pipe of the engine 120. The throttle body 161 is also provided with a transmission mechanism 162 including a plurality of gears, and the throttle valve 170 for opening/closing an air intake passage 161*a* connected to the air intake pipe. The throttle valve 170 is rotationally supported by the throttle body 161 through a shaft portion 163 of the throttle valve 170. A rotating force from the transmission mechanism 162 is transmitted to the shaft portion 163 of the throttle valve 170.

The rotating shaft of the motor 160 is coupled to the transmission mechanism 162, through which the shaft portion 163 of the throttle valve 170 is rotated. By rotating the shaft portion 163, the opening degree of the throttle valve 170 (throttle opening degree) is adjusted.

Friction torque is applied to the motor 160 from the shaft-connection portion of the throttle valve 170 (portion f1 in FIG. 5(*a*)) and from the inside mechanism of the motor 160.

As shown in FIG. 5(*b*), the friction torque applied to the motor 160 is maximized when the motor 160 is stationary, and is reduced once the motor 160 is driven. In this connection, the initial value $\Delta duty_i$ (=$h_2b$) of the PWM duty correction value Δduty in the function h2, is approximately determined according to the following equations (1) to (3):

$$E(V) = (Da + \Delta duty_i)(\%) \times E_{in}(V)/100 \quad (1)$$

wherein $E_{in}$ is the voltage across the terminals of the motor 160, Da is the PWM duty when the throttle opening degree is maintained, and E is the voltage substantially applied to the motor 160 by a PWM control.

$$I(A) = E(V)/R(\Omega) \quad (2)$$

wherein I is the motor armature current and R is the motor armature resistance.

$$I(A) \times K_T > Tm \quad (3)$$

wherein $K_T$ is the motor torque constant and Tm is the friction torque applied to the motor 160 when it is stationary.

With the static friction torque Tm mentioned above treated as a constant, the PWM control parameter initial value (the initial value of the PWM duty correction value Δduty=the initial value of $h_2b$ in this example) is set. According to the arrangement of the throttle body 161, however, a gear backlash portion gb is present in the transmission mechanism 162. Accordingly, the throttle valve 170 cannot always be finely moved by the initial value calculated by the equations (1) to (3).

On the other hand, there is a time lag between the change in PWM duty and the change in motor current I. FIG. 6(*a*)–FIG. 6(*d*) are views illustrating the behavior of the motor current and the PWM duty. FIG. 6(*a*) shows changes in PWM duty with the passage of time, FIG. 6(*b*) shows changes in motor current I with the passage of time, FIG. 6(*c*) shows changes in real throttle opening degree with the passage of time, and FIG. 6(*d*) shows changes in real engine speed with the passage of time.

Figure 6:
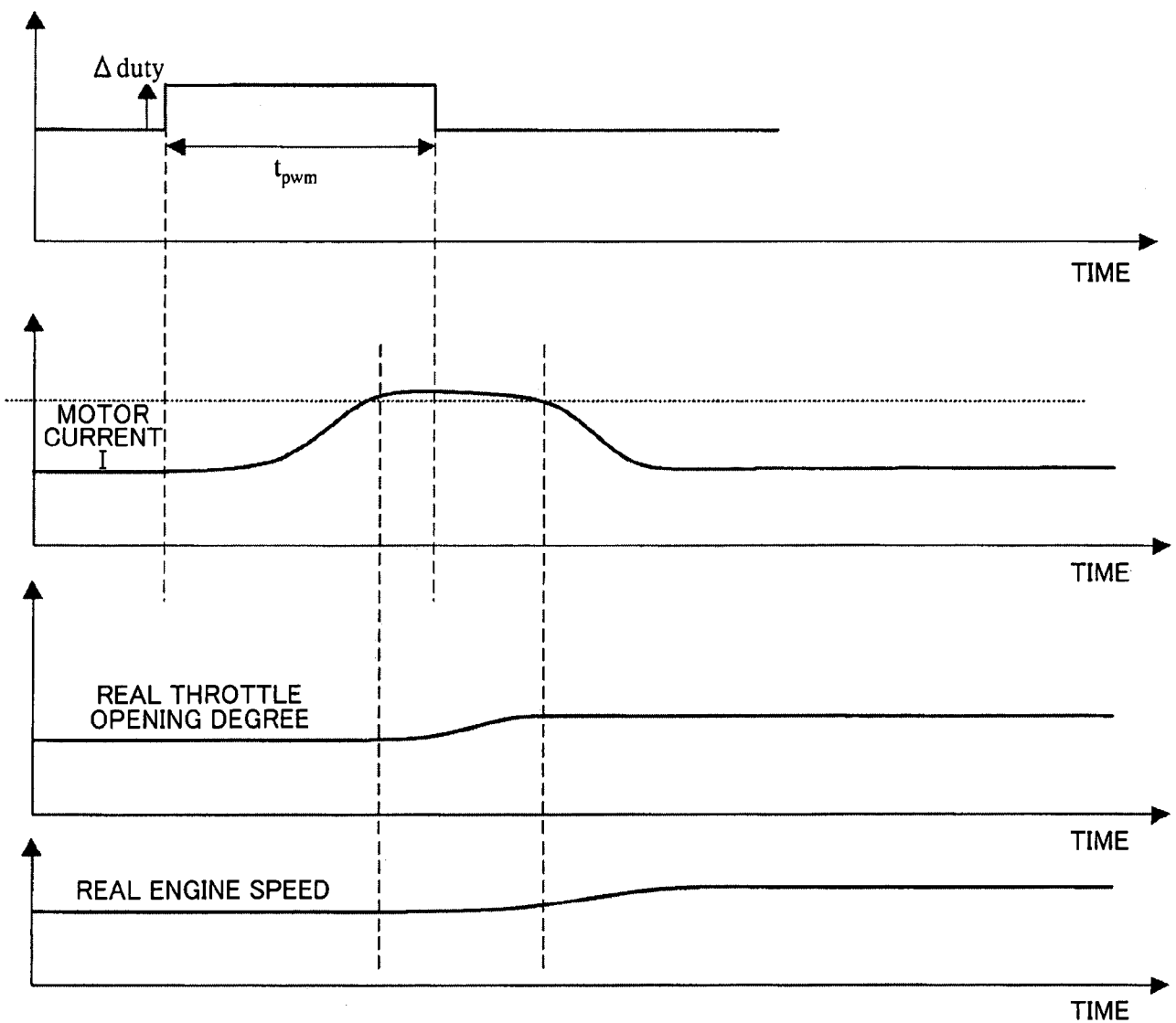
FIGS. 6(*a*), 6(*b*), 6(*c*) and 6(*d*) are views illustrating the behaviors of PWM duty, motor electric current, throttle opening degree and engine speed.

As shown in FIG. 6(*a*) and FIG. 6(*b*), a delay is observed from the change in PWM duty to the actual change in motor current I. Further, with a certain delay, the throttle opening degree is changed (See FIG. 6(*c*)). Then, with a certain delay, the real engine speed is changed.

The response delay of the motor current I can be expressed by electric time constant Te (a period of time required to reach 63.2% of the final value) shown in the following equation (4):

$$\text{Electric time constant: } Te(s) = L(H)/R(\Omega) \quad (4)$$

wherein L is the motor inductance.

It is desired to shorten the PWM duty correction value maintaining time $t_{pwm}$ during which the PWM duty correction value Δduty is continuously applied, and it is also desired to minimize the PWM duty correction frequency $n_{pwm}$. In this connection, when setting the initial values of the PWM control parameters (the initial values of the coefficients $h_1b$, $h_2b$, $h_3b$), the equations (1) to (4) are used, and with the delay of the motor current I taken into consideration, the minimized initial values are set for both the PWM duty correction value maintaining time $t_{pwm}$ and the PWM duty correction frequency $n_{pwm}$ out of the PWM control parameters.

FIG. 6(*a*) to FIG. 6(*d*) show an example of operations for finely driving the throttle valve 170 at the time of idle speed control. In this operational example, the PWM micro-pulse calculating unit 240 supplies a PWM duty (control signal) corresponding to the PWM duty correction value Δduty which generates torque required for exceeding the static friction torque (See FIG. 5(*b*)). After the throttle valve 170 starts driving, the PWM micro-pulse calculating unit 240 supplies the before-correction PWM duty (retention duty ratio) immediately after the passage of the PWM duty correction value maintaining time $t_{pwn}$.

The PWM micro-pulse calculating unit 240 corrects the function h1 to function h3 based on the function updating data input from the PWM micro-pulse control table updating unit 250.

Input into the PWM micro-pulse control table updating unit 250 are the target engine speed change amount ΔN* calculated by the target engine speed change amount calculating unit 220, and the real engine speed N calculated by the real engine speed calculating unit 210.

The PWM micro-pulse control table updating unit 250 has a memory 250*m* for storing an input real engine speed N. Stored in the memory 250*m* is a real engine speed $N_{old}$ calculated by the real engine speed calculating unit 210 before the PWM micro-pulse control is executed in the current control cycle. The PWM micro-pulse control table updating unit 250 obtains a deviation between the real engine speed $N_{old}$ stored in the memory 250*m* and the real engine speed N as changed by the PWM micro-pulse control in the current control cycle, and this deviation is defined as a real engine speed change amount $\Delta N(=N-N_{old})$. However, the deviation between the real engine speeds before and after the PWM micro-pulse control in the current control cycle may not be defined as the real engine speed change amount ΔN, however, the real engine speed change amount ΔN may be obtained by executing a predetermined operation on these real engine speeds before and after the PWM micro-pulse control.

The PWM micro-pulse control table updating unit 250 further generates function updating data for updating the function tables h1, h2, h3 of the PWM control parameters of the PWM micro-pulse calculating unit 240. The PWM micro-pulse control table updating unit 250 generates function updating data based on entered information, and supplies the generated function updating data to the PWM micro-pulse calculating unit 240.

The function updating data are values for offsetting, by a predetermined amount, each of the values of the functions h1 to h3 of the PWM micro-pulse calculating unit 240. More specifically, the function updating data are used for increasing/decreasing the coefficients $h_1b$, $h_2b$, $h_3b$ of the functions h1, h2, h3. The function updating data may be data for increasing/decreasing the coefficients $h_1a$, $h_2a$, $h_3a$ of the functions h1, h2, h3, and may also be data for increasing/decreasing both the coefficients $h_1a$, $h_2a$, $h_3a$ and the coefficients $h_1b$, $h_2b$, $h_3b$. Of course, it is not always required to change the function values of all functions h1, h2, h3. For example, only the function h2 value for determining the PWM duty correction value Δduty may increased/decreased according to the function updating data.

By giving function updating data to the PWM micro-pulse calculating unit 240 to offset the function values, the functions h1, h2, h3 for obtaining the PWM control parameters are substantially changed. More specifically, the functions h1, h2, h3 are updated when the deviation of the real engine speed change amount ΔN from the target engine speed change amount ΔN*, is still large even after there a PWM micro-pulse control has been executed in which, at the correction frequency $n_{pwm}$, a PWM duty correction control is repeatedly executed in which the PWM duty correction value Δduty is continuously applied during the time $t_{pwn}$. More specifically, the function updating data for offsetting the function values are provided from the PWM micro-pulse control table updating unit 250 to the PWM micro-pulse calculating unit 240. Accordingly, at the PWM micro-pulse control at the subsequent control cycle, the PWM control parameters are determined by the updated functions h1, h2, h3. Therefore, the engine speed can be changed as targeted.

Before such updating of the functions h1, h2, h3, the PWM control parameters are determined based on the initial values of the coefficients $h_1b$, $h_2b$, $h_3b$.

The PWM signal generating unit 280 stores, in a memory (register) 280*m*, a PWM duty input from the PWM micro-pulse calculating unit 240. Also, the PWM signal generating unit 280 generates a PWM signal based on the PWM duty (control signal) stored in the memory 280*m*, and supplies the PWM signal to the motor 160.

As mentioned above, the motor 160 is disposed on the throttle body 161 and begins driving based on a PWM signal from the PWM signal generating unit 280 to change the angle (opening degree) of the throttle valve 170. Based on changes in the angle of the throttle valve 170, the throttle opening degree is changed to change the intake air amount, thereby to change the engine speed.

Figure 7:
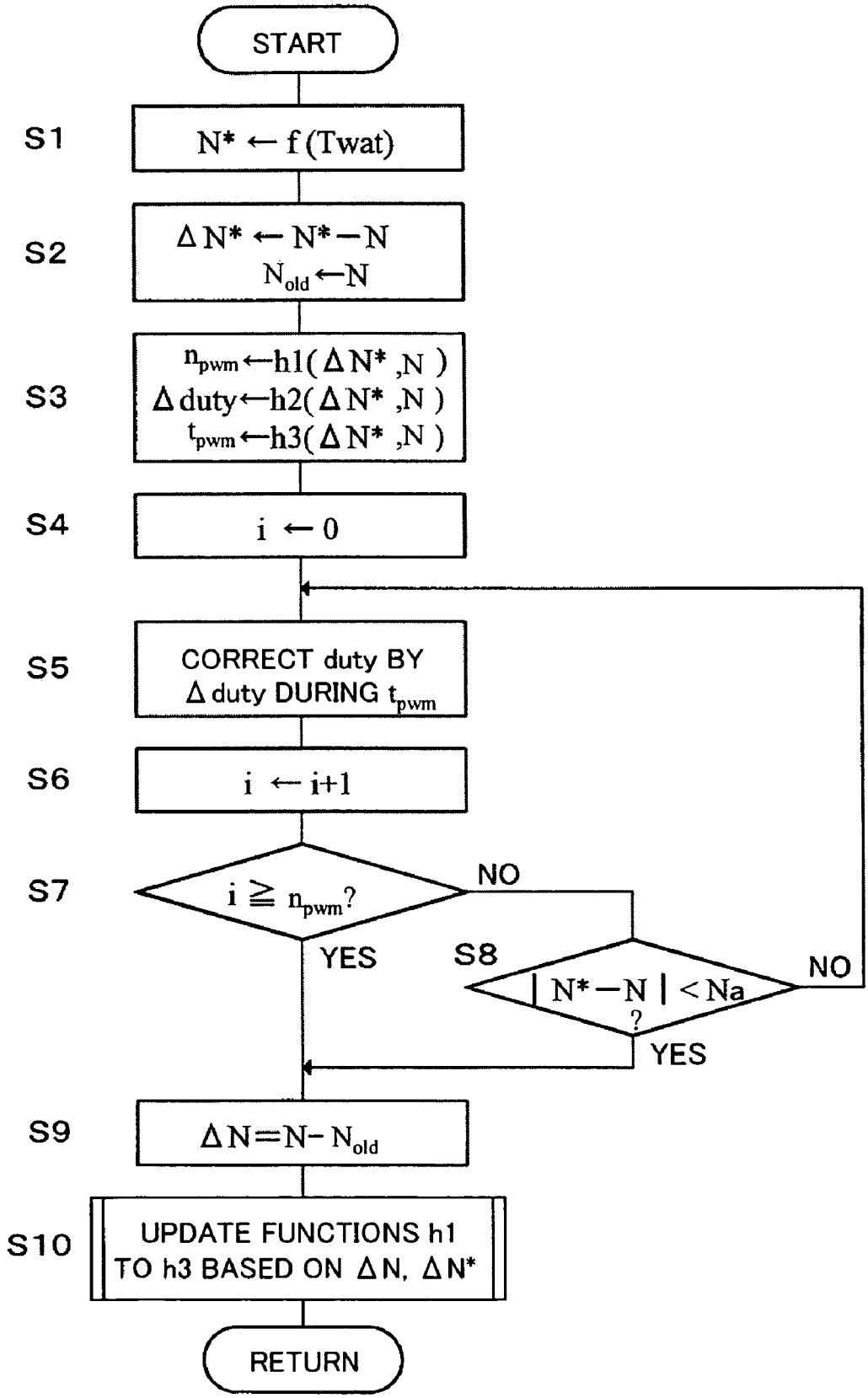
FIG. 7 is a flow chart illustrating an engine speed control processing.

FIG. 7 is a flow chart illustrating the operation of an engine speed control apparatus according to this preferred embodiment. The processing shown in FIG. 7 is repeatedly executed at predetermined control cycles.

First, the water temperature calculating unit 140 calculates the water temperature $T_{wat}$ based on an input from the water temperature sensor 130, and the target engine speed calculating unit 260 calculates a target engine speed N* based on the water temperature $T_{wat}$ thus calculated (Step S1).

At Step S2, the target engine speed change amount calculating unit 220 subtracts a real engine speed N from the target engine speed N* to calculate the target engine speed change amount ΔN* (=N*−N). The PWM micro-pulse control table updating unit 250 stores, in the memory 250*m*, the real engine speed N calculated by the real engine speed calculating unit 210 as a real engine speed recorded value $N_{old}$. The real engine speed recorded value $N_{old}$ is to be used, at Step S9 to be discussed later, as the real engine speed before throttle opening degree adjustment by a PWM micro-pulse control. This real engine speed recorded value $N_{old}$ corresponds to the result of the PWM micro-pulse control at the previous control cycle.

Then, at Step S3, the PWM micro-pulse calculating unit 240 calculates PWM control parameters based on the target engine speed change amount ΔN* and the real engine speed N. More specifically, the PWM micro-pulse calculating unit 240 obtains a PWM duty correction frequency $n_{pwm}$ by the function h1, a PWM duty correction value Δduty by the function h2, and a PWM duty correction value maintaining time $t_{pwn}$ by the function h3.

Then, at Step S4, the PWM micro-pulse calculating unit 240 clears the count value i of a counter which counts the PWM duty correction frequency $n_{pwm}$.

At Step S5, the PWM micro-pulse calculating unit 240 corrects the PWM duty by increasing or decreasing, during the PWM duty correction value maintaining time $t_{pwn}$ calculated at Step S3, the PWM duty correction value Δduty calculated at Step S3 based on the retention duty ratio mentioned above (Da in FIG. 3).

At Step S6, the PWM micro-pulse calculating unit 240 adds 1 to the count value i of the PWM duty correction frequency counter. At Step S7, the PWM micro-pulse calculating unit 240 determines whether or not the PWM duty correction frequency has reached the PWM duty correction frequency $n_{pwm}$ calculated at Step S4 ($i \geqq n_{pwm}$).

When the PWM duty correction has been repeatedly executed at the PWM duty correction frequency $n_{pwm}$ ($i \geqq n_{pwm}$), the sequence proceeds to Step S9. When the correction has not yet been executed at the PWM duty correction frequency $n_{pwm}$ ($i < n_{pwm}$), the sequence proceeds to Step S8.

At Step S8, the PWM micro-pulse calculating unit 240 judges whether or not the deviation ($=|N^*-N|$) (Engine speed deviation) of the current real engine speed N from the target engine speed N*, is within an allowable range (less than an engine speed deviation allowable value $N\alpha$. $N\alpha>0$). When the engine speed deviation amount $|N^*-N|$ is not less than the engine speed deviation allowable value $N\alpha$, the PWM micro-pulse calculating unit 240 returns its sequence to Step S5. When the engine speed deviation amount $|N^*-N|$ is less than the engine speed deviation allowable value $N\alpha$, the sequence proceeds to Step S9.

In the manner described above, the PWM duty correction is repeated at predetermined time intervals until either of the conditions that the PWM duty correction frequency reaches the PWM duty correction frequency $n_{pwm}$ and that the real engine speed N approaches sufficiently the target engine speed N* is satisfied. The PWM duty correction is repeatedly executed at predetermined time intervals because there is a time lag between the PWM duty correction and the change in real engine speed, as discussed in connection with FIG. 6(*a*)–FIG. 6(*d*).

At Step S9, the PWM micro-pulse control table updating unit 250 calculates a real engine speed change amount $\Delta N(=N-N_{old})$ based on the real engine speed N obtained after the PWM micro-pulse control at the current control cycle has been finished (YES at Step S7 or S8), and on the real engine speed recorded value $N_{old}$ stored in the memory 250*m* before the PWM micro-pulse control is executed.

At Step S10, the PWM micro-pulse control table updating unit 250 executes a function updating process for updating the PWM micro-pulse control parameter functions h1 to h3 based on the target engine speed change amount $\Delta N^*$ and the real engine speed change amount $\Delta N$. This function updating process may be executed with the target engine speed N* also being taken into consideration.

When the function updating data are provided from the function updating process, the PWM micro-pulse calculating unit 240 offsets the function values of the functions h1, h2, h3 according to the given function updating data.

The processing described above is repeatedly executed at control cycles.

Figure 8:
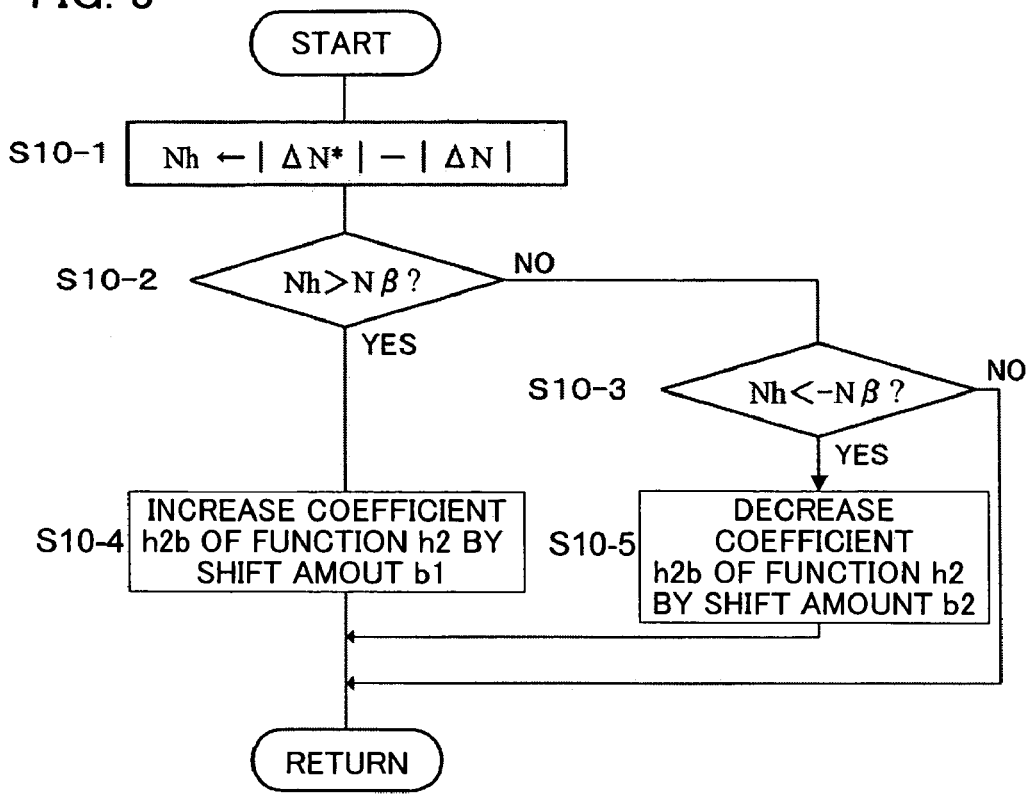
FIG. 8 is a flow chart illustrating a processing of updating a PWM micro-pulse control parameter function.

FIG. 8 is a flow chart illustrating the PWM micro-pulse control parameter function updating process to be executed at Step S10 in FIG. 7.

At Step S10-1, the PWM micro-pulse control table updating unit 250 calculates a difference $Nh(=|\Delta N^*|-|\Delta N|)$ (engine speed change amount deviation) between the absolute value of the real engine speed change amount $\Delta N$ calculated at Step S9 (See FIG. 7) and the absolute value of the target engine speed change amount $\Delta N^*$ calculated at Step S2.

At Step S10-2, the PWM micro-pulse control table updating unit 250 judges whether or not the calculated engine speed change amount deviation Nh, is greater than a previously set judgment value $N\beta(>0)$ (constant value) for updating the PWM micro-pulse control functions. The sequence proceeds to Step S10-4 when the engine speed change amount deviation Nh is greater than the judgment value $N\beta$, and the sequence proceeds to Step S10-3 when the engine speed change amount deviation Nh is less than the judgment value $N\beta$.

The case where the engine speed change amount deviation Nh is greater than the judgment value $N\beta$ (YES at Step S10-2), refers to the case where the real engine speed N has not been sufficiently changed after the PWM micro-pulse control has been executed. In such a case, at Step S10-4, the PWM micro-pulse control table updating unit 250 supplies function updating data for increasing the parameter function output values such that the throttle valve 170 is moved a greater amount than before, and then finishes the function updating processing. As an example, this Step S10-4 is arranged so as to supply a function updating data which increases the coefficient $h_2b$ of the function h2 by a shift amount b1 (b1>0). Then, the function value of the function h2 for calculating the PWM duty correction value $\Delta$duty is uniformly increased by the shift amount b1.

The shift amount b1 may be a constant value or may be variable according to the engine speed change amount deviation Nh. When the shift amount b1 is determined according to the engine speed change amount deviation Nh, it is preferable to determine the shift amount b1 within a range not greater than a predetermined upper limit in order to prevent a sudden change in engine speed.

Figure 9:
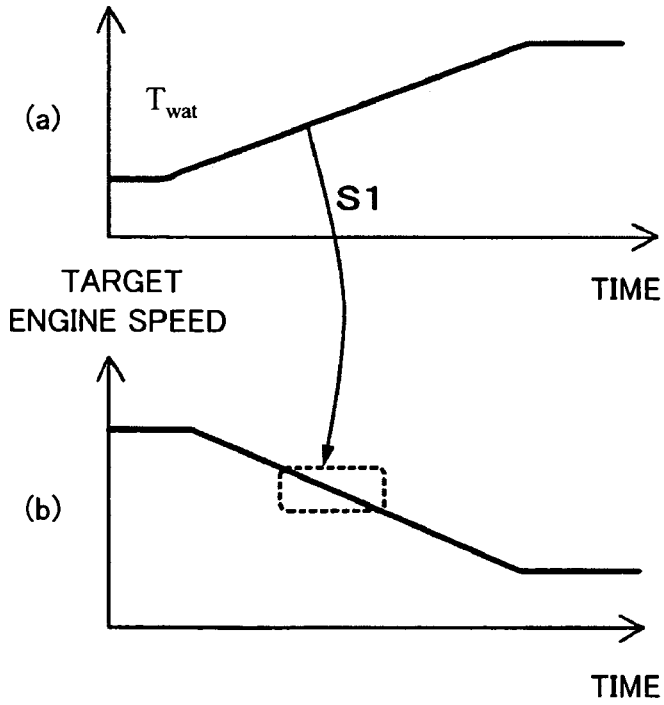
FIGS. 9(*a*) and (*b*) are view illustrating a processing timing of an engine speed control apparatus, in which FIG. 9(*a*) shows changes in cooling water temperature with the passage of time, and FIG. 9(*b*) shows changes in target engine speed with the passage of time.
Figure 10:
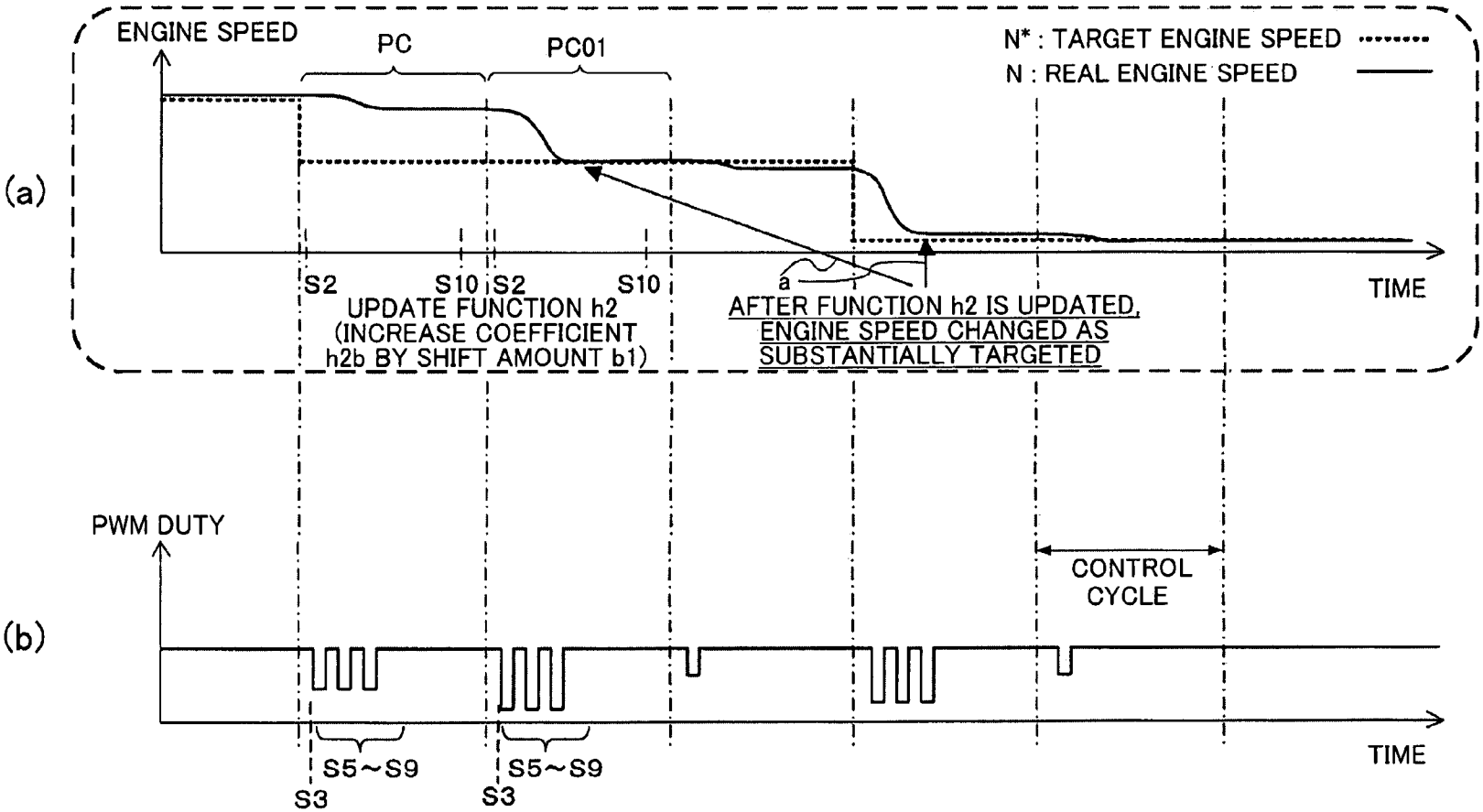
FIGS. 10(*a*) and 10(*b*) are views illustrating a processing timing of the engine speed control apparatus, in which FIG. 10(*a*) shows changes in engine speed and FIG. 10(*b*) shows changes in PWM duty.
Figure 11:
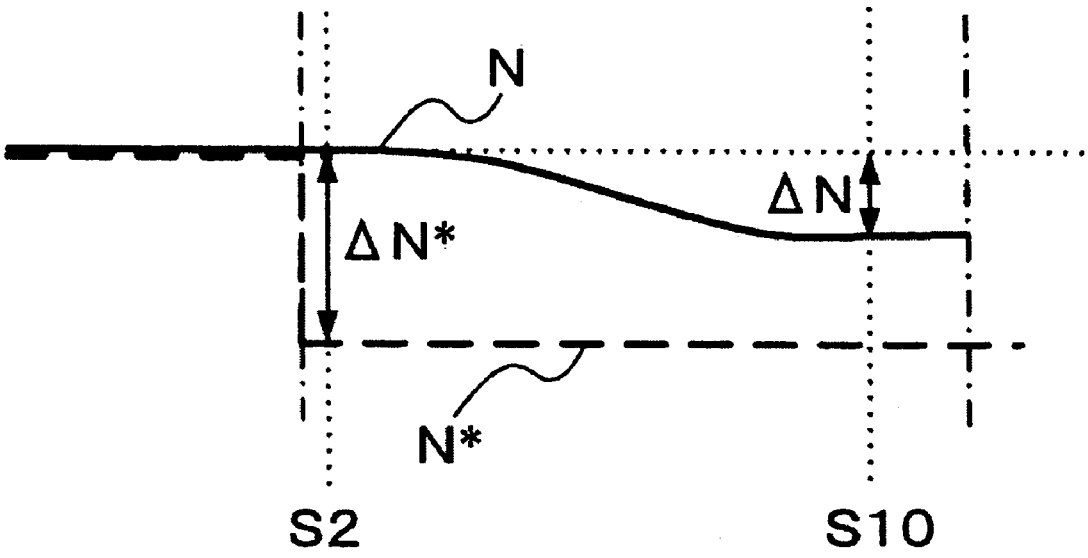
FIG. 11 is a view illustrating, in enlargement, the relationship between a target engine speed and a real engine speed in a control cycle PC in FIGS. 10(*a*) and 10(*b*)

FIG. 9(*a*), FIG. 9(*b*), FIG. 10(*a*), FIG. 10(*b*) and FIG. 11 show processing timings when the real engine speed change amount $|\Delta N|$ is less than the target engine speed change amount $|\Delta N^*|(|\Delta N^*|-|\Delta N|>N\beta)$.

FIGS. 9(*a*) and 9(*b*) are views showing a processing timing of an engine speed control apparatus according to this preferred embodiment, illustrating the behaviors of the water temperature and the target engine speed.

FIG. 10(*a*) and FIG. 10(*b*) are views illustrating an engine speed control timing when the real engine speed change is less than the target ($|\Delta N^*|-|\Delta N|>N\beta$) at the processing timing at which the water temperature $T_{wat}$ is increased as shown in FIGS. 9(*a*) and 9(*b*). FIG. 10(*a*) shows changes in engine speed and FIG. 10(*b*) shows a PWM duty corresponding to the engine speed changes in FIG. 10(*a*). FIG. 11 shows the relationship between the target engine speed N* and the real engine speed N at the control cycle PC in FIG. 10(*a*). Further, the execution timings of main steps in the flow chart in FIG. 7 are also shown in FIGS. 9(*a*) and 9(*b*), FIG. 10(*a*), FIG. 10(*b*) and FIG. 11.

In the example in FIG. 10(*a*), after the function h2 is updated (to increase the coefficient $h_2b$ by the shift amount b1 in this example) at Step S10 in a control cycle PC, the engine speed is changed substantially as targeted, as indicated by arrows a.

More specifically, the PWM duty is corrected as reduced three times by the processings at Steps S3–S8 at the control cycle PC. Accordingly, the motor 160 drives the throttle valve 170 in the closing direction to reduce the throttle opening degree, resulting in a reduction in real engine speed N. However, the real engine speed change amount $|\Delta N|$ is small, and therefore the difference between the real engine speed N and the target engine speed N* is large. Accordingly, the function h2 is updated at Step S10 in the control cycle PC.

At the next control cycle PC01, a PWM duty correction value $\Delta$duty is obtained based on the updated function h2 and then applied. As a result, the PWM duty is corrected three times by a negative PWM duty correction value $\Delta$duty having a large absolute value such that the real engine speed N is brought close to the target engine speed N* as shown by the arrow a.

On the other hand, at Step S10-3 in FIG. 8, the PWM micro-pulse control table updating unit 250 determines whether or not the engine speed change amount deviation Nh calculated at Step S10-1, is smaller than the previously set judgment value [−Nβ] (a negative constant value). When the engine speed change amount deviation Nh is not less than the judgment value [−Nβ], the function updating process is finished. More specifically, when the target engine speed change amount (ΔN*) and the real engine speed change amount (ΔN) are substantially equal to each other, the function updating is not executed.

Figure 12:
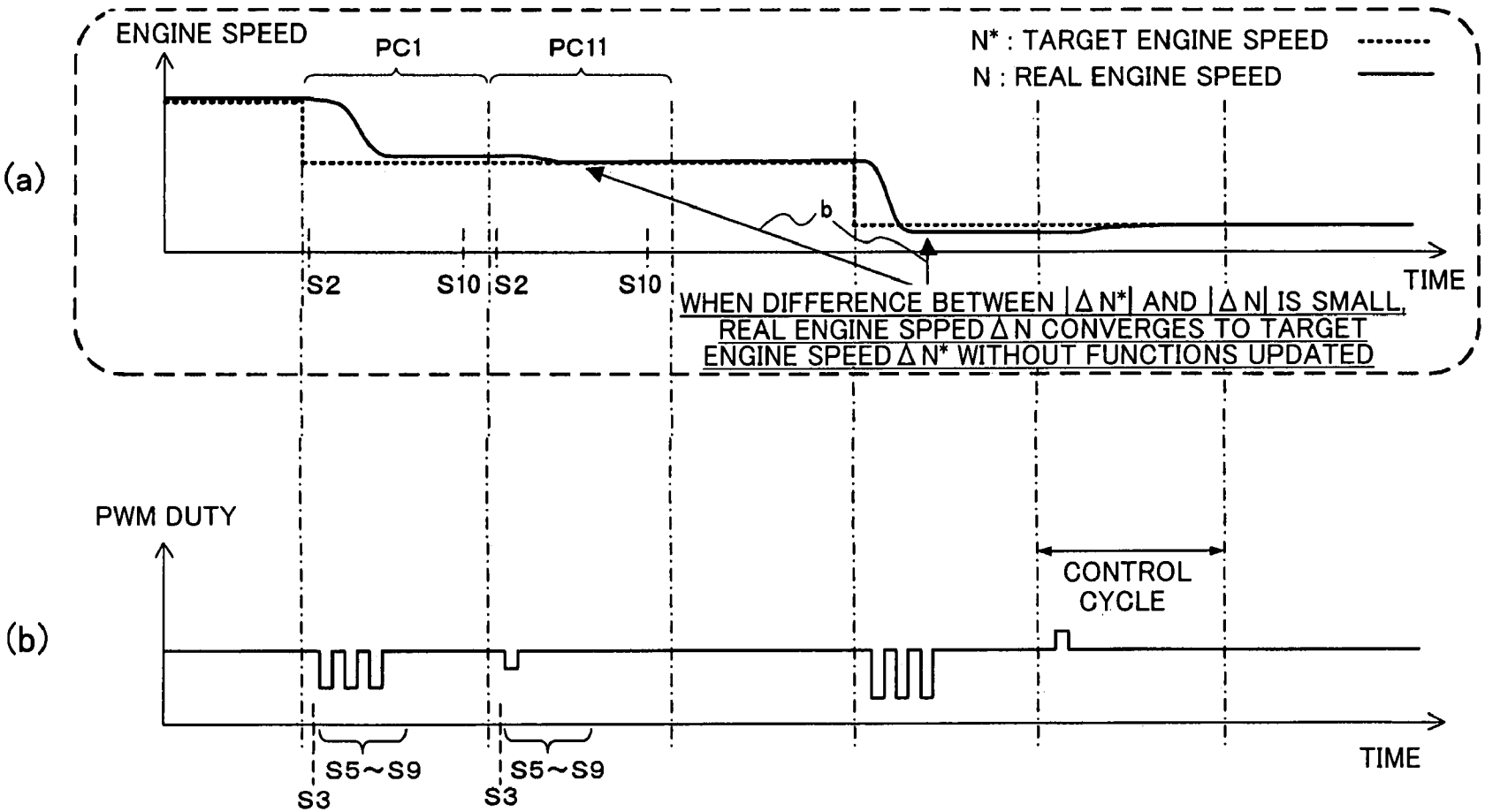
FIGS. 12(*a*) and 12(*b*) are views illustrating a processing timing of an engine speed control apparatus, in which FIG. 12(*a*) shows changes in engine speed and FIG. 12(*b*) shows changes in PWM duty.
Figure 13:
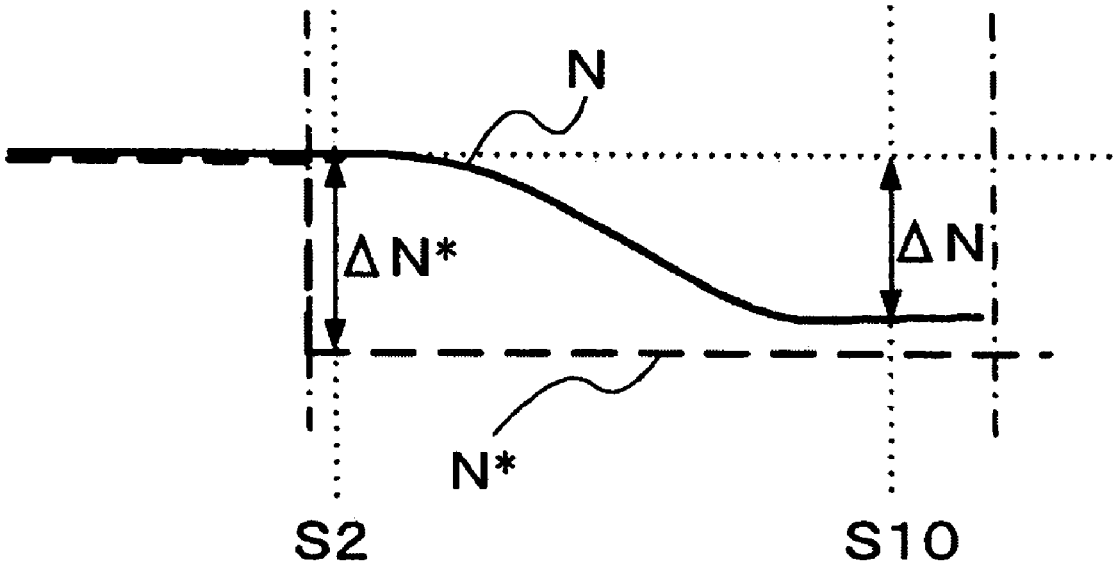
FIG. 13 is a view illustrating, in enlargement, the relationship between a target engine speed and a real engine speed in a control cycle PC1 in FIGS. 12(*a*) and 12(*b*)

FIG. 12(*a*) and FIG. 12(*b*) are views illustrating engine speed control timings when the real engine speed is changed substantially as targeted. FIG. 12(*a*) shows changes in engine speed, and FIG. 12(*b*) shows a PWM duty corresponding to the engine speed changes in FIG. 12(*a*). FIG. 13 shows the relationship between the target engine speed and the real engine speed at the control cycle PC1 in FIG. 12(*a*). Further, the timings of main steps in the flow chart in FIG. 7 are also shown in FIG. 12(*a*), FIG. 12(*b*) and FIG. 13.

As shown by an arrow b in FIG. 12(*a*), when the difference between the target engine speed change amount |ΔN*| and the real engine speed change amount |ΔN| is small, this difference is eliminated by repeating a series of control processes without the PWM parameter functions being updated. Accordingly, the real engine speed N converges to the target engine speed N*.

More specifically, at the control cycle PC1, the PWM duty is corrected by reducing the PWM duty three times as shown in FIG. 12(*b*). Accordingly, the motor 160 drives the throttle valve 170 in the closing direction. As a result, the throttle opening degree is reduced and the real engine speed N is reduced down to the vicinity of the target engine speed N*. Accordingly, no parameter functions are updated at Step S10 in the control cycle PC1.

At the control cycle PC11 subsequent to the control cycle PC1, the PWM duty is corrected by reducing the PWM duty once. This causes the real engine speed N to be substantially equal to the target engine speed N* as shown by the arrow b. In the example in FIG. 12(*b*), at the control cycle PC11 subsequent to the control cycle PC1, the absolute value of the PWM duty correction value Δduty is smaller than the absolute value of the PWM duty correction value Δduty at the control cycle PC1, and the PWM duty correction frequency is also reduced. This corresponds to the fact that the target engine speed change amount ΔN* has become small. In addition, the PWM duty correction value maintaining time $t_{pwm}$ may also be reduced.

When the real engine speed undergoes a change even by a small amount, this means that the motor-generated torque required for finely moving the throttle valve 170 has been generated. Therefore, the PWM duty correction value Δduty is not required to be changed and the function h2 is not required to be changed.

At Step S10-3 in FIG. 8, when the engine speed change amount deviation Nh is smaller than the judgment value [−Nβ], the sequence proceeds to Step S10-5.

In this case, the real engine speed change amount ΔN is greater than the target engine speed change amount ΔN*, which indicates that the real engine speed N has been excessively changed. Therefore, the PWM micro-pulse control table updating unit 250 reduces the parameter function output value such that the throttle valve 170 is moved more finely. More specifically, the PWM micro-pulse control table updating unit 250 supplies a function updating data for reducing the function output value to the PWM micro-pulse calculating unit 240, and then the parameter function updating processing is finished.

In the example in FIG. 8, at Step S10-5, the PWM micro-pulse control table updating unit 250 reduces, by a shift amount b2 (>0), the value of the coefficient $h_2b$ of the function h2 for calculating the PWM duty correction value, thus correcting the output of the function h2. The shift amount b2 may be a constant value, or may be variable according to the engine speed change amount deviation Nh. When the shift amount b2 is determined according to the engine speed change amount deviation Nh, it is preferable to determine the shift amount b2 within a range that is not greater than a predetermined upper limit in order to prevent a sudden change in engine speed.

Figure 14:
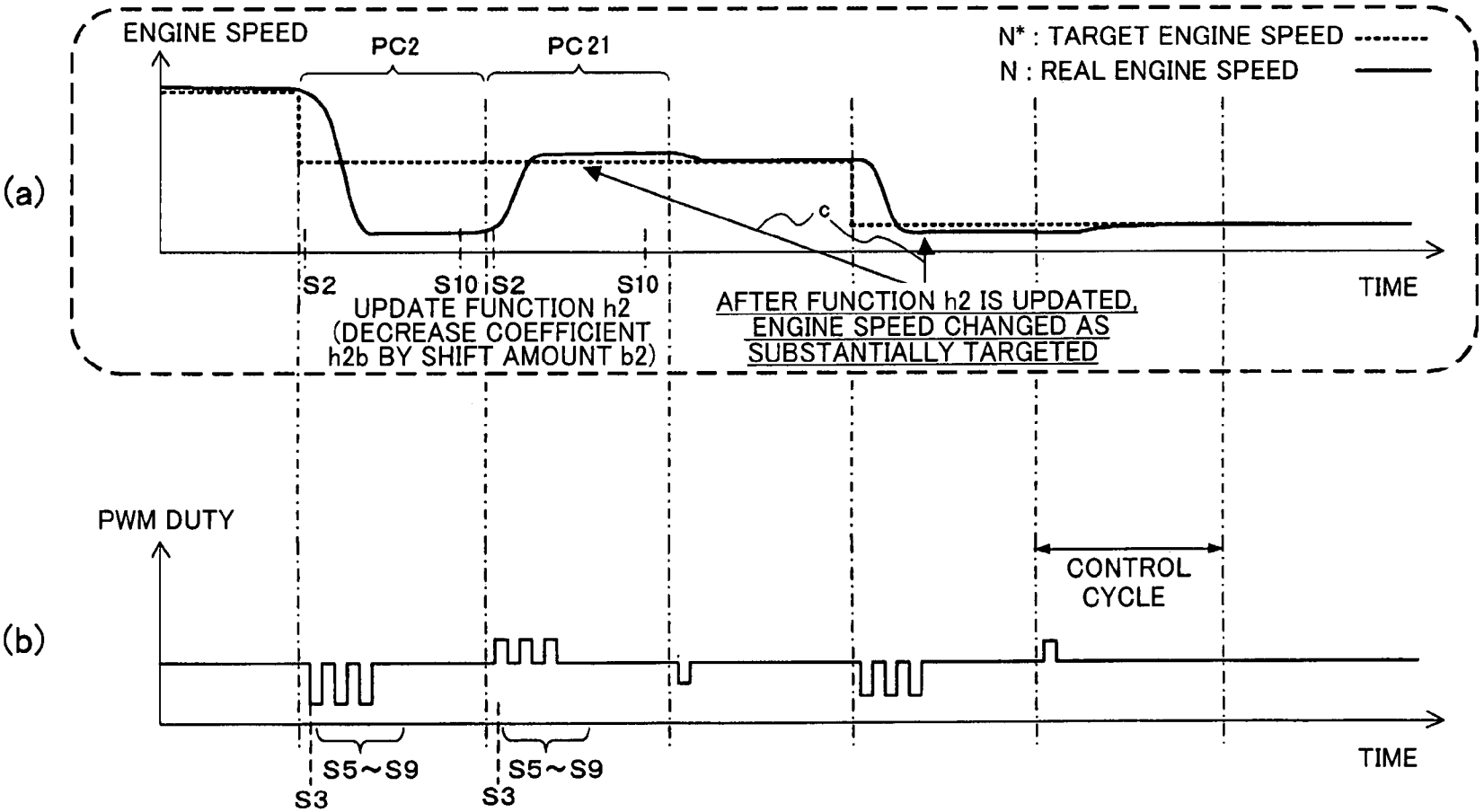
FIGS. 14(*a*) and 14(*b*) are views illustrating a processing timing of an engine speed control apparatus, in which FIG. 14(*a*) shows changes in engine speed and FIG. 14(*b*) shows changes in PWM duty.
Figure 15:
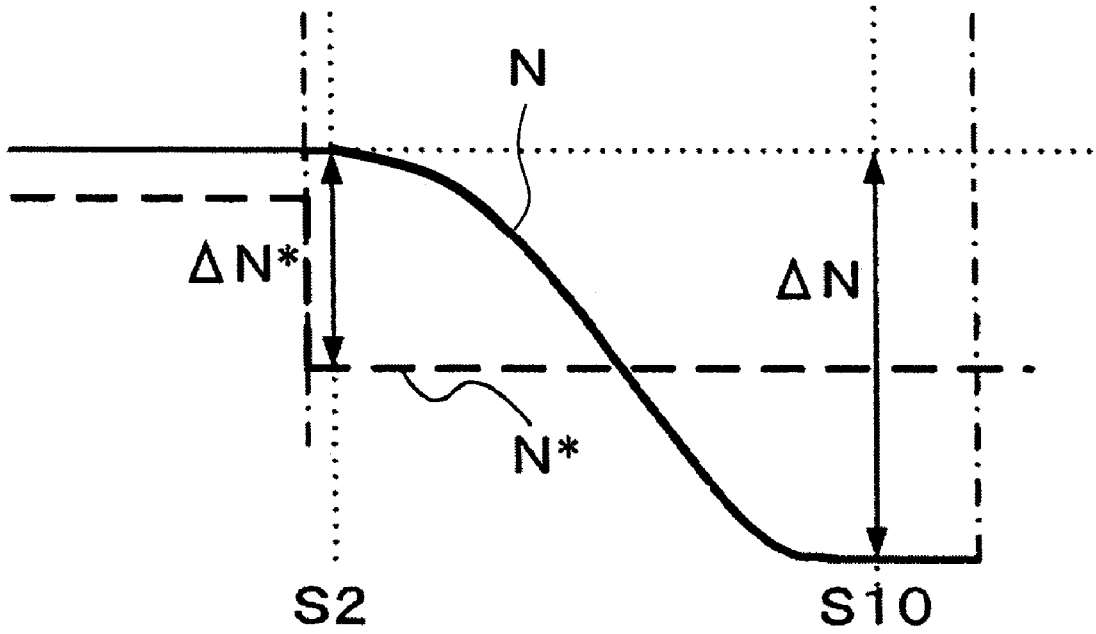
FIG. 15 is a view illustrating, in enlargement, the relationship between a target engine speed and a real engine speed in a control cycle PC2 in FIG. 14.

FIG. 14(*a*) and FIG. 14(*b*) are views illustrating engine speed control timings when the real engine speed change is greater than the target change. FIG. 14(*a*) shows changes in engine speed, and FIG. 14(*b*) shows a PWM duty corresponding to the engine speed changes in FIG. 14(*a*). FIG. 15 shows the relationship between the target engine speed and the real engine speed at a control cycle PC2 in FIG. 14(*a*). Further, the execution timings of main steps in the flow chart in FIG. 7 are also shown in FIG. 14(*a*), FIG. 14(*b*) and FIG. 15.

As shown in FIG. 14(*a*), after the function h2 has been updated (to reduce the coefficient $h_2b$ by the shift amount b2) at Step S10 in a control cycle PC2, the engine speed is changed substantially as targeted as indicated by arrows c.

More specifically, the PWM duty is corrected and reduced three times at the control cycle PC2. Accordingly, the real engine speed N changes excessively, and the real engine speed change amount |ΔN| is much greater than the target engine speed change amount |ΔN*|. Therefore, the parameter function h2 is updated by the processing at Step S10 in the control cycle PC2.

At the next control cycle PC21, the PWM duty increasing correction (Δduty>0) is executed three times, and the real engine speed N is substantially equal to the target engine speed N* as shown by the arrows c.

In the flow chart in FIG. 8, the description has been made of the parameter function updating process in which the function h2 for the duty correction value Δduty is updated, but the functions h1 and h3 may also be updated in a similar manner.

Figure 16:
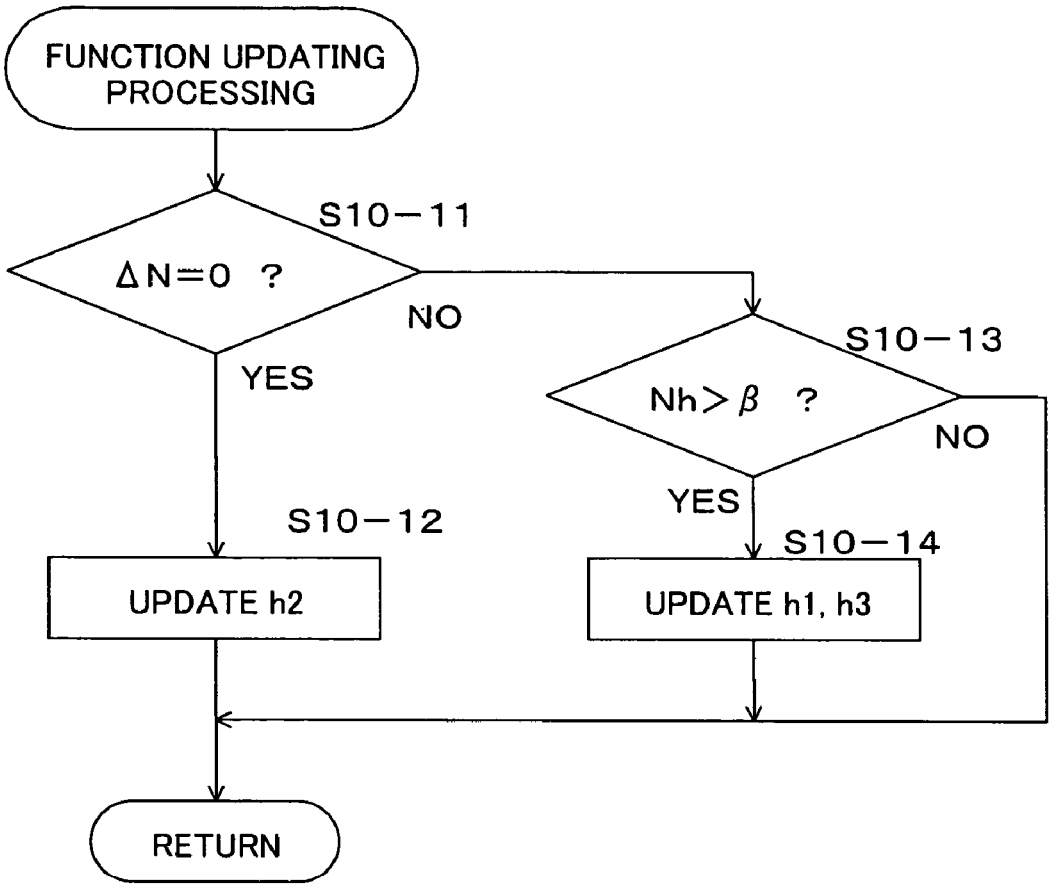
FIG. 16 is a flow chart illustrating another example of a parameter function updating processing.

FIG. 16 is a flowchart of another example of the parameter function updating process.

As an example of the case of increasing only the PWM duty correction value Δduty at Step S10-4 in FIG. 8, the real engine speed undergoes no change, that is, the real engine speed change amount $|\Delta AN|=|N-N_{old}|=0$. When the real engine speed change amount ΔN is equal to 0, the throttle valve 170 to be driven by the motor 160 is not operated at all and the motor-generated torque is less than the static friction torque (See FIG. 5(*b*)). Accordingly, even though the PWM duty correction frequency $n_{pwm}$ or the PWM duty correction value maintaining time $t_{pwn}$ is changed, the motor-generated torque is not changed. More specifically, to increase the motor-generated torque to move the throttle valve 170, the PWM duty correction value Δduty must be changed.

In the example shown in FIG. 16, the PWM micro-pulse control table updating unit 250 determines whether or not the real engine speed change amount |ΔN| is 0 (Step S10-11). When |ΔN|=0, the PWM micro-pulse control table updating unit 250 provides, to the PWM micro-pulse calculating unit 240, a function updating data for increasing (increasing in the zone of $\Delta N^*>0$ and decreasing in the zone of $\Delta N^*<0$) the function value of the function h2, thereby to substantially update the function h2 (Step S10-12).

Further, there are instances where the real engine speed change amount $|\Delta N|$ is not 0 (NO at Step S10-11), however, the difference between the real engine speed change amount $|\Delta N|$ and the target engine speed change amount $|\Delta N^*|$ is large, that is, where $|N|\neq 0$ and $|Nh|>\beta$ (wherein $Nh=|\Delta N^*|-|\Delta N|$ and $\beta>>N\beta$) (Step S10-13). More specifically, the real engine speed change amount $|\Delta N|$ is much less than the target engine speed change amount $|\Delta N^*|$ (insufficient PWM duty correction).

In such a case, the PWM micro-pulse control table updating unit 250 provides, to the PWM micro-pulse calculating unit 240, a function updating data for updating the function h1 which determines the PWM duty correction frequency $n_{pwm}$, or the function h3 which determines the PWM duty correction value maintaining time $t_{pwn}$ (Step S10-14). Thus, the real engine speed change amount $\Delta N$ in the PWM micro-pulse control at the subsequent control cycle can be increased.

Also, by updating the function h2 for determining the PWM duty correction value $\Delta$duty, the real engine speed change amount $\Delta N$ may be increased/decreased. However, if the PWM duty correction value $\Delta$duty is increased excessively, the generated torque becomes excessive. This makes fine-adjustment of the driving amount difficult. If the PWM duty correction value $\Delta$duty is decreased too much, the throttle valve 170 cannot be operated properly.

As mentioned above, the initial value of the PWM duty correction value $\Delta$duty is set such that the generated torque minimally required for moving the throttle valve 170, is generated from the motor 160. Accordingly, when the real engine speed change amount $|\Delta N|$ is not 0, it is easier to finely adjust the driving amount of the throttle valve 170 by changing the PWM duty correction frequency $n_{pwm}$ or the PWM duty correction value maintaining time $t_{pwn}$ while maintaining the initial value of the PWM duty correction value $\Delta$duty unchanged.

The determination of whether or not the real engine speed change amount $|\Delta N|$ at Step S10-11 is equal to 0 involves determining whether or not the real engine speed change amount $|\Delta N|$ can be regarded as substantially 0. Accordingly, this determination can be replaced, for example, with a determination of whether the real engine speed change amount $|\Delta N|$ is not greater than a small constant $\alpha(>0)$.

When the PWM duty correction frequency $n_{pwm}$ is not less than 2, it is preferable to provide a certain time interval between adjacent duty-corrected micro-pulse trains. Thus, the relationship between the PWM duty correction frequency $n_{pwm}$ and the real engine speed change amount $\Delta N(=N-N_{old})$, is substantially proportional.

In this case, for example, if the real engine speed change amount $\Delta N$ is 5 rotations when the PWM duty correction frequency $n_{pwm}$ is 1, then the real engine speed change amount $\Delta N$ is approximately 10 rotations when the PWM duty correction frequency $n_{pwm}$ is 2. Thus, when a PWM micro-pulse control is executed by changing the PWM duty correction frequency $n_{pwm}$, the real engine speed change amount $\Delta N$ is more easily determined.

Also, it is preferable to provide a certain time interval between adjacent duty-corrected micro-pulse trains when a PWM micro-pulse control is executed by changing the PWM duty correction value maintaining time $t_{pwn}$. However, the relationship between the PWM duty correction value maintaining time $t_{pwn}$ and the real engine speed change amount $\Delta N$ is not proportional. However, the real engine speed change amount $\Delta N$ is substantially changed by slight changes in the PWM duty correction value maintaining time $t_{pwn}$. Accordingly, a longer control cycle is not required as compared to the case in which the PWM duty correction frequency $n_{pwm}$ is changed. Accordingly, the PWM micro-pulse control cycle is required to be shortened, it is preferable to execute the PWM micro-pulse control with the PWM duty correction value maintaining time $t_{pwn}$ being corrected.

According to the preferred embodiment discussed above, the duty of a PWM signal supplied to the motor 160 for driving the throttle valve 170 is corrected by the PWM duty correction value $\Delta$duty at the PWM duty correction frequency $h_{pwm}$,and the PWM duty correction at each time is maintained for the PWM duty correction value maintaining time $t_{pwn}$. This enables the opening degree of the throttle valve 170 to be finely controlled, with the angular precision of about 0.02° maintained, by a feedforward control using the target engine speed change amount $\Delta N^*$, instead of a feedback control using an output of a throttle position sensor (TPS). This angular precision of about 0.02° is equivalent to that obtained by the arrangement in which a bypass passage (secondary passage) is disposed in parallel to the engine main air intake passage and in which the opening degree of the idle speed control valve (ISCV) disposed in the bypass passage, is adjusted by an engine-control unit. Thus, the real engine speed can be brought close to the target engine speed while the throttle opening degree is controlled with precision that is equivalent to that provided by the control using the ISCV.

Further, the ISCV is not always required, and an amplifier for amplifying an output signal of a throttle position sensor is also not required. Therefore, a simple and economical structure is provided to control an engine speed, particularly an idle speed requiring a precise control.

The initial values of the PWM control parameters (the initial function values of the functions h1, h2, h3, particularly the coefficients $h_1b$, $h_2b$, $h_3b$) of the PWM duty correction frequency $n_{pwm}$, the PWM duty correction value $\Delta$duty and the PWM duty correction value maintaining time $t_{pwn}$, are set such that the motor 160 generates the minimum torque required for exceeding the static friction torque which prevents the displacement of the throttle valve 170. Accordingly, even though the PWM duty is corrected with the use of the initial function values of the PWM control parameters, the real engine speed is brought close to the target engine speed. In particular, even at the time of idle speed control, the throttle valve 170 is accurately opened/closed to the target opening degree position from the stationary status.

The PWM micro-pulse control table updating unit 250 calculates, at each execution of PWM micro-pulse control (at each control cycle), a real engine speed change amount $\Delta N(=N-N_{old})$ with the use of the real engine speeds N and $N_{old}$ before and after PWM micro-pulse control. Further, the PWM micro-pulse control table updating unit 250 updates, as necessary, any of the functions for determining the PWM control parameters, with the use of the real engine speed change amount $\Delta N$ and the target engine speed change amount $\Delta N^*$ (and the real engine speed N as necessary). More specifically, as necessary, at least one of the function h1 for determining the PWM duty correction frequency $n_{pwm}$, the function h2 for determining the PWM duty correction value $\Delta$duty, and the function h3 for determining the PWM duty correction value maintaining time $t_{pwn}$ is changed.

If the throttle valve 170 is not opened/closed to the target opening degree with the PWM duty corrected by the PWM control parameters in the PWM micro-pulse calculating unit 240, the function of at least one PWM control parameter can be changed such that the throttle valve 170 is accurately opened/closed as desired at the subsequent processing (at the subsequent control cycle).

In this preferred embodiment, the torque applied to the throttle valve 170 driven by the motor 160 is not constant due to influences of the friction f1 of the shaft of the throttle valve 170, the gear backlash gb of the transmission mechanism of the throttle valve 170, the return spring and other factors. Accordingly, the engine speed control apparatus according to this preferred embodiment is arranged such that the real engine speed change amount ΔN is fed back and the function h2 of the PWM duty correction value Δduty is corrected by the PWM micro-pulse control table updating unit 250, thus assuring fine and accurate movement of the throttle valve 170 (See FIG. 8).

Further, in the processing shown in FIG. 16, the PWM micro-pulse control table updating unit 250 updates the function h2 for the PWM duty correction value Δduty when the real engine speed change amount ΔN undergoes no change. This enables the throttle valve 170 to be accurately driven to control the engine speed.

Further, in the processing shown in FIG. 16, when the real engine speed change amount |ΔAN| is much less than the target engine speed change amount |ΔN*|, even though the real engine speed N undergoes a change by correction of the PWM duty, the PWM micro-pulse control table updating unit 250 changes the function h1 for the PWM duty correction frequency $n_{pwm}$ or the function h3 for the PWM duty correction value maintaining time $t_{pwn}$. This enables the engine speed to be efficiently and accurately controlled with high precision while the state of fine movement of the throttle valve 170 by a PWM duty correction, is maintained.

Second Preferred Embodiment

Figure 17:
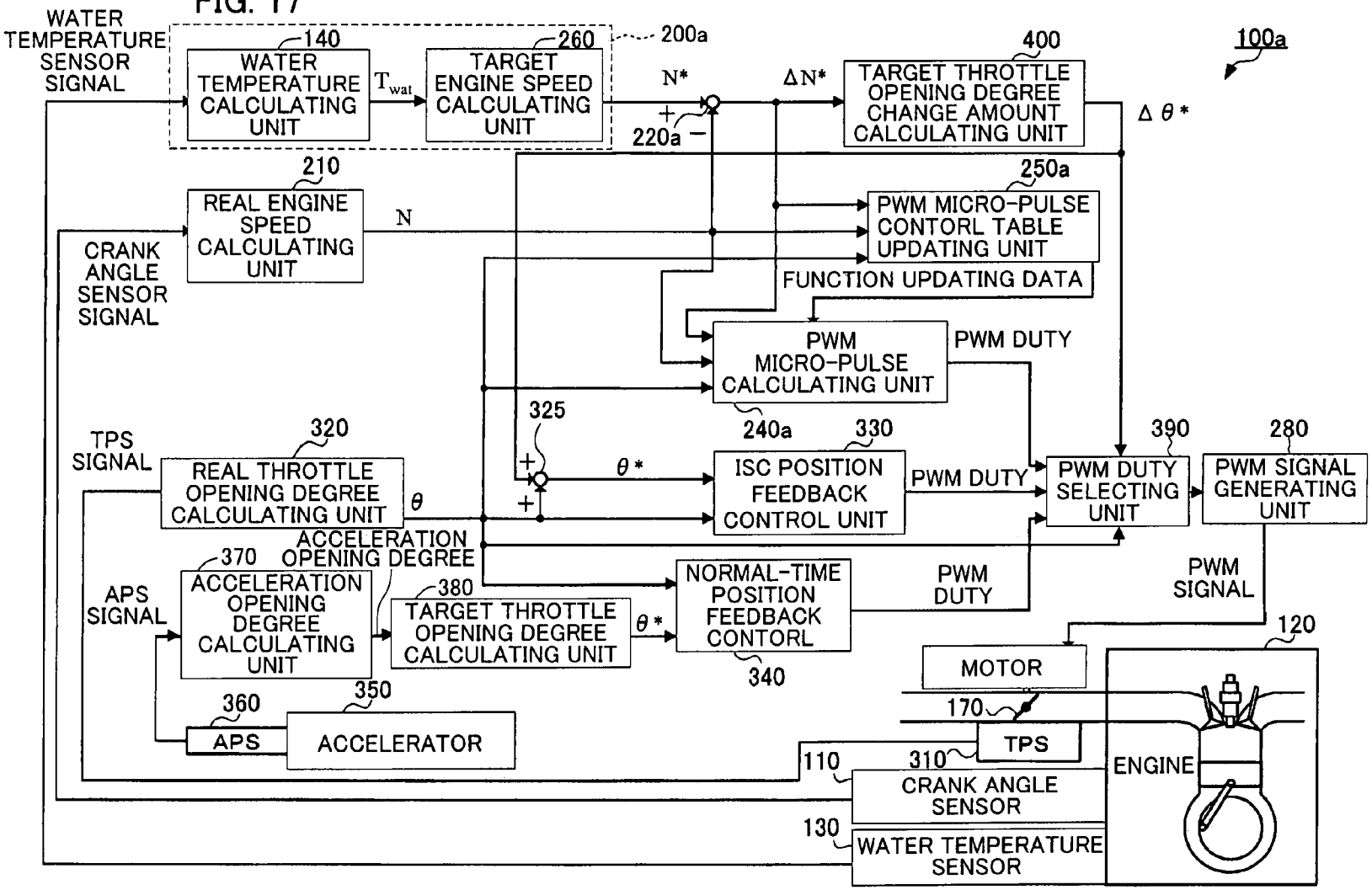
FIG. 17 is a block diagram illustrating the arrangement of an engine system according to a second preferred embodiment of the present invention.

FIG. 17 is a block diagram illustrating the arrangement of an engine system according to a second preferred embodiment of the present invention. This engine system includes an engine 120, and an engine speed control apparatus 100*a* for controlling the speed of the engine 120. This engine speed control apparatus 100*a* has a basic arrangement similar to that of the engine speed control apparatus 100 according to the first preferred embodiment of the present invention shown in FIG. 1. Therefore, like parts are designated by like reference numerals used in FIG. 1, and the description thereof is omitted in the following description.

A throttle valve 170 includes a throttle position sensor (hereinafter referred to as TPS) 310. The TPS 310, defined by a potentiometer or other suitable device, is arranged to detect the opening degree of the throttle valve 170 and to provide a detected signal (hereinafter referred to as a TPS signal) to a real throttle opening degree calculating unit 320.

The real throttle opening degree calculating unit 320 calculates a real throttle opening degree θ based on the TPS signal input from the TPS 310, and then supplies the real throttle opening degree θ to a PWM micro-pulse control table updating unit 250*a*, a PWM micro-pulse calculating unit (a first control signal calculating unit) 240*a*, a PWM duty selecting unit 390, an ISC position feedback control unit (a second control signal calculating unit) 330, and a normal-time position feedback control unit 340.

The ISC position feedback control unit 330 calculates a PWM duty serving as a control signal for a PWM control of a motor 160 based on a target throttle opening degree θ* (=θ+Δθ*) (wherein Δθ* is a target throttle opening degree change amount) input from a target throttle opening degree calculating unit 325 and a real throttle opening degree θ input from the real throttle opening degree calculating unit 320, and then supplies the calculated PWM duty to the PWM duty selecting unit 390.

The normal-time position feedback control unit 340 calculates a PWM duty serving as a control signal for a PWM control of the motor 160 based on a target throttle opening degree θ* input from a target throttle opening degree calculating unit 380 and a real throttle opening degree θ input from the real throttle opening degree calculating unit 320, and then supplies the PWM duty thus calculated to the PWM duty selecting unit 390.

An accelerator position sensor (APS) 360 is disposed in the vicinity of an accelerator (e.g., an accelerator pedal in a four-wheeled vehicle, an accelerator grip in a two-wheeled vehicle or an accelerator lever in an engine generator) 350 for controlling outputs from the engine 120. The APS 360 detects the opening degree (operation amount) of the accelerator 350 and supplies the detected signal (hereinafter referred to as APS signal) to an accelerator opening degree calculating unit 370.

The accelerator opening degree calculating unit 370 calculates an accelerator opening degree based on an APS signal entered from the APS 360, and supplies the calculated accelerator opening degree to the target throttle opening degree calculating unit 380.

The target throttle opening degree calculating unit 380 is an accelerator tracking target throttle opening degree calculating unit for generating a target throttle opening degree θ* based on an accelerator opening degree signal entered from the accelerator opening degree calculating unit 370. The target throttle opening degree calculating unit 380 supplies the generated target throttle opening degree θ* to the normal-time position feedback control unit 340.

A target engine speed change amount calculating unit 220*a* calculates a difference (engine speed deviation) between a target engine speed N* and a real engine speed N. In this preferred embodiment, the engine speed deviation, serves as a target engine speed change amount ΔN*, however, such a target engine speed change amount ΔN* may be determined by executing a predetermined operation on this engine speed deviation.

The target engine speed change amount calculating unit 220*a* provides the calculated target engine speed change amount ΔN* to a target throttle opening degree change amount calculating unit 400, in addition to the PWM micro-pulse calculating unit 240*a* and the PWM micro-pulse control table updating unit 250*a*.

The target throttle opening degree change amount calculating unit 400 includes a table which stores values of the target throttle opening degree change amount Δθ* corresponding to various values of the target engine speed change amount ΔN*. The target throttle opening degree change amount calculating unit 400 calculates the target throttle opening degree change amount Δθ* based on both the table and the target engine speed change amount ΔN* entered from the target engine speed change amount calculating unit 220*a*.

The target throttle opening degree change amount calculating unit 400 supplies the calculated target throttle opening degree change amount Δθ* to the PWM duty selecting unit 390 and the target throttle opening degree calculating unit 325.

The target throttle opening degree calculating unit 325 receives a real throttle opening degree θ and a target throttle opening degree change amount Δθ*, based on which a target throttle opening degree θ* (=θ+Δθ*) is calculated, which is then provided to the ISC position feedback control unit 330.

The PWM micro-pulse calculating unit 240*a* calculates PWM control parameters for a PWM micro-pulse control (PWM duty correction frequency $n_{pwm}$, PWM duty correction value Δduty, and PWM duty correction value maintaining time $t_{pwn}$) based on the target engine speed change amount ΔN* calculated by the target engine speed change amount calculating unit 220*a* and based on the real engine speed N calculated by a real engine speed calculating unit 210. A PWM duty according to these PWM control parameters is supplied from the PWM micro-pulse calculating unit 240*a* to a PWM signal generating unit 280.

The PWM micro-pulse calculating unit 240*a* functions similar to the PWM micro-pulse calculating unit 240 mentioned above, and is arranged to receive a real throttle opening degree θ.

Accordingly, the PWM control parameters are changed according to the actual opening degree θ of the throttle valve 170 to be drivingly controlled by a PWM micro-pulse control. More specifically, the PWM control parameters are determined using a function of (i) a target engine speed change amount ΔN*, (ii) a real engine speed N, and (iii) a real throttle opening degree θ.

Similar to the first preferred embodiment described above, the PWM control parameters are determined using a function of both a target engine speed change amount ΔN* and a real engine speed N, without a real throttle opening degree θ being taken into consideration. In such a case, the real throttle opening degree θ is not required to be input into the PWM micro-pulse calculating unit 240*a*.

In practice, the static friction torque of the throttle valve 170 is not always uniform in all opening degree zones. Accordingly, when the PWM control parameters are determined with the real throttle opening degree θ taken into consideration, the throttle valve 170 is more accurately opened/closed.

The PWM micro-pulse control table updating unit 250*a* functions similar to the PWM micro-pulse control table updating unit 250 mentioned earlier, and is arranged to receive a real throttle opening degree θ. This enables the real opening degree of the throttle valve 170 to be taken into consideration when determining the function updating data to be provided to the PWM micro-pulse calculating unit 240*a*.

Based on the real throttle opening degree θ and the target throttle opening degree change amount Δθ*, the PWM duty selecting unit 390 selects one of a signal from the PWM micro-pulse calculating unit 240*a*, a signal from the ISC position feedback control unit 330 and a signal from the normal-time position feedback control unit 340, and then supplies the selected signal to the PWM signal generating unit 280.

Figure 18:
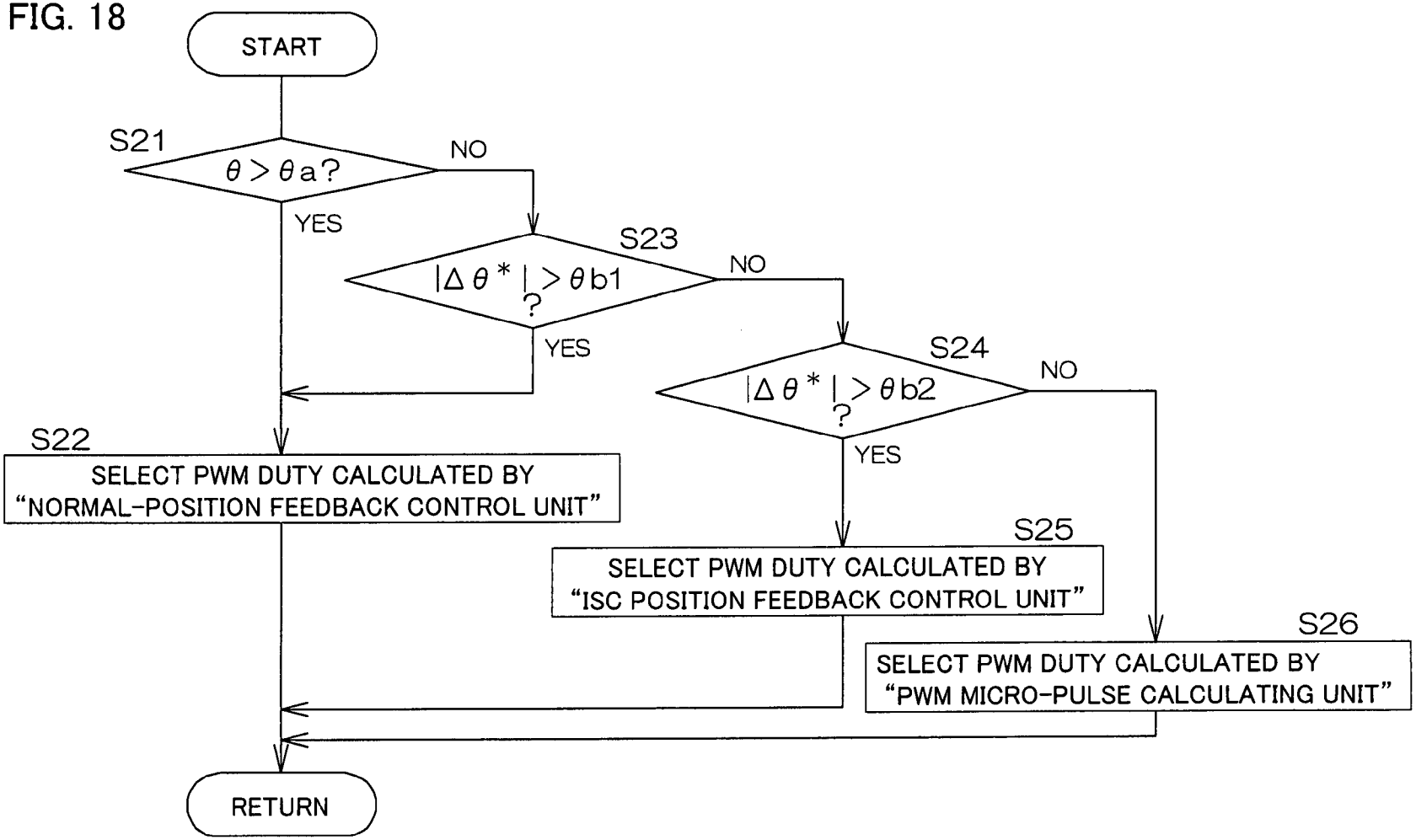
FIG. 18 is a flow chart illustrating a processing of a PWM duty selecting unit.

FIG. 18 is a flow chart illustrating the processing of the PWM duty selecting unit 390. When the real throttle opening degree θ exceeds a predetermined threshold θa (>0) (YES at Step S21), the PWM duty selecting unit 390 determines that the accelerator 350 has been operated, and then selects a control signal (representing a PWM duty) supplied from the normal-time position feedback control unit 340, and supplies the selected control signal (Step S22).

When the real throttle opening degree θ is not greater than the threshold θa (NO at Step S21), the PWM duty selecting unit 390 determines whether or not the target throttle opening degree change amount absolute value |Δθ*| exceeds a first selection judgment value θb1 (>0) (Step S23). If the target throttle opening degree change amount absolute value |Δθ*| exceeds a first selection judgment value θb1 (>0), the PWM duty selecting unit 390 selects the control signal supplied from the normal-time position feedback control unit 340, and then supplies the selected control signal.

When the judgment at Step S23 is negative, that is, when |Δθ*|≦θb1, the PWM duty selecting unit 390 further determines whether or not the target throttle opening degree change amount absolute value |Δθ*| exceeds a second selection judgment value θb2 (wherein θb1>θb2>0) (Step S24). If the target throttle opening degree change amount absolute value |Δθ*| exceeds a second selection judgment value θb2 (wherein θb1>θb2>0) (Step S24), the PWM duty selecting unit 390 selects the control signal supplied from the ISC position feedback control unit 330, and supplies the selected control signal (Step S25).

On the other hand, when the judgment at Step S24 is negative, that is, when |Δθ*|≦θb2, the PWM duty selecting unit 390 selects the control signal supplied from the PWM micro-pulse calculating unit 240, and supplies the selected control signal (Step S26).

In this preferred embodiment, the second judgment value θb2 is set to be equal to the input resolution of a TPS signal. Accordingly, when |Δθ*|≦θb1, an ISC position feedback control is executed if the target throttle opening degree change amount absolute value |Δθ*| is greater than the TPS signal input resolution, and a PWM micro-pulse control is executed if the absolute value |Δθ*| is not greater than the TPS signal input resolution.

Thus, depending on the situation, any of the ISC position feedback control high in response speed, the PWM micro-pulse control capable of finely controlling the engine speed, and the normal-time position feedback control is selected by the operation of the PWM duty selecting unit 390.

The following shows an example of the engine speed control using the engine speed control apparatus 100*a*.

Figure 19:
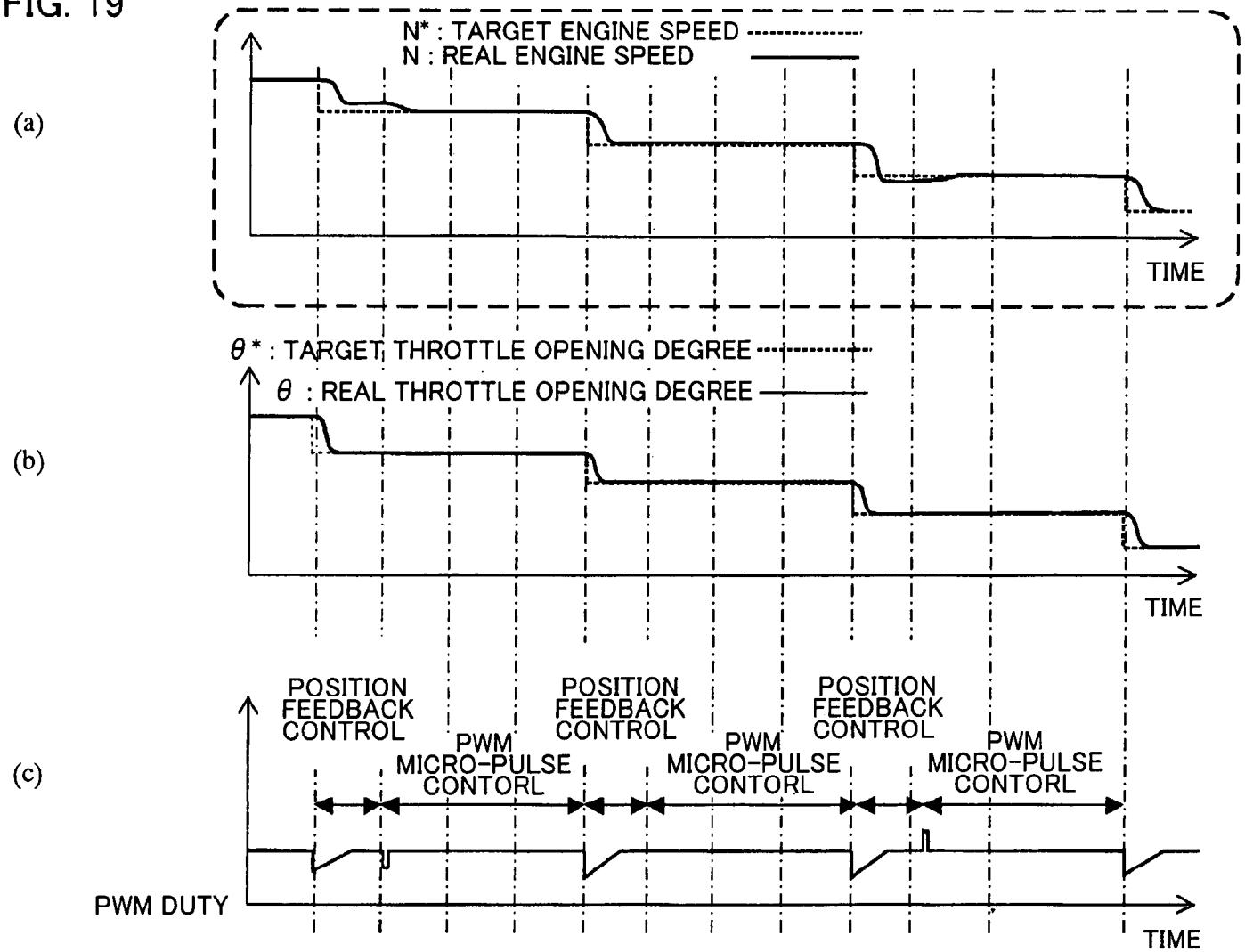
FIGS. 19(*a*), 19(*b*), and 19(*c*) are time charts illustrating an engine speed control processing according to the second preferred embodiment, at the time when an ISC position feedback control and a PWM micro-pulse control are executed as switched from each other, in which FIG. 19(*a*) shows the behaviors of a real engine speed and a target engine speed, FIG. 19(*b*) shows the behaviors of a real throttle opening degree and a target throttle opening degree, and FIG. 19(*c*) shows changes in PWM duty.

FIGS. 19(*a*), 19(*b*) and 19(*c*) show examples of time charts in which the PWM micro-pulse control and the ISC position feedback control are used in combination with each other. FIG. 19(*a*) shows the behavior of the real engine speed N and the target engine speed N* when the ISC position feedback control and the PWM micro-pulse control are executed as switched from one to another. FIG. 19(*b*) shows the behavior of the real throttle opening degree θ and the target throttle opening degree θ*, and FIG. 19(*c*) shows changes in PWM duty.

When the target engine speed is changed in steps, the target throttle opening degree tracks the target engine speed changes and is also changed in steps. Accordingly, the target throttle opening degree change amount absolute value |Δθ*| increases. Therefore, at a control cycle in which the target throttle opening degree is changed in steps, the ISC position feedback control is executed such that the PWM duty is changed substantially linearly. On the other hand, at a cycle in which the change in target throttle opening degree is small, the PWM micro-pulse control is executed such that the PWM duty is changed in pulses.

Figure 20:
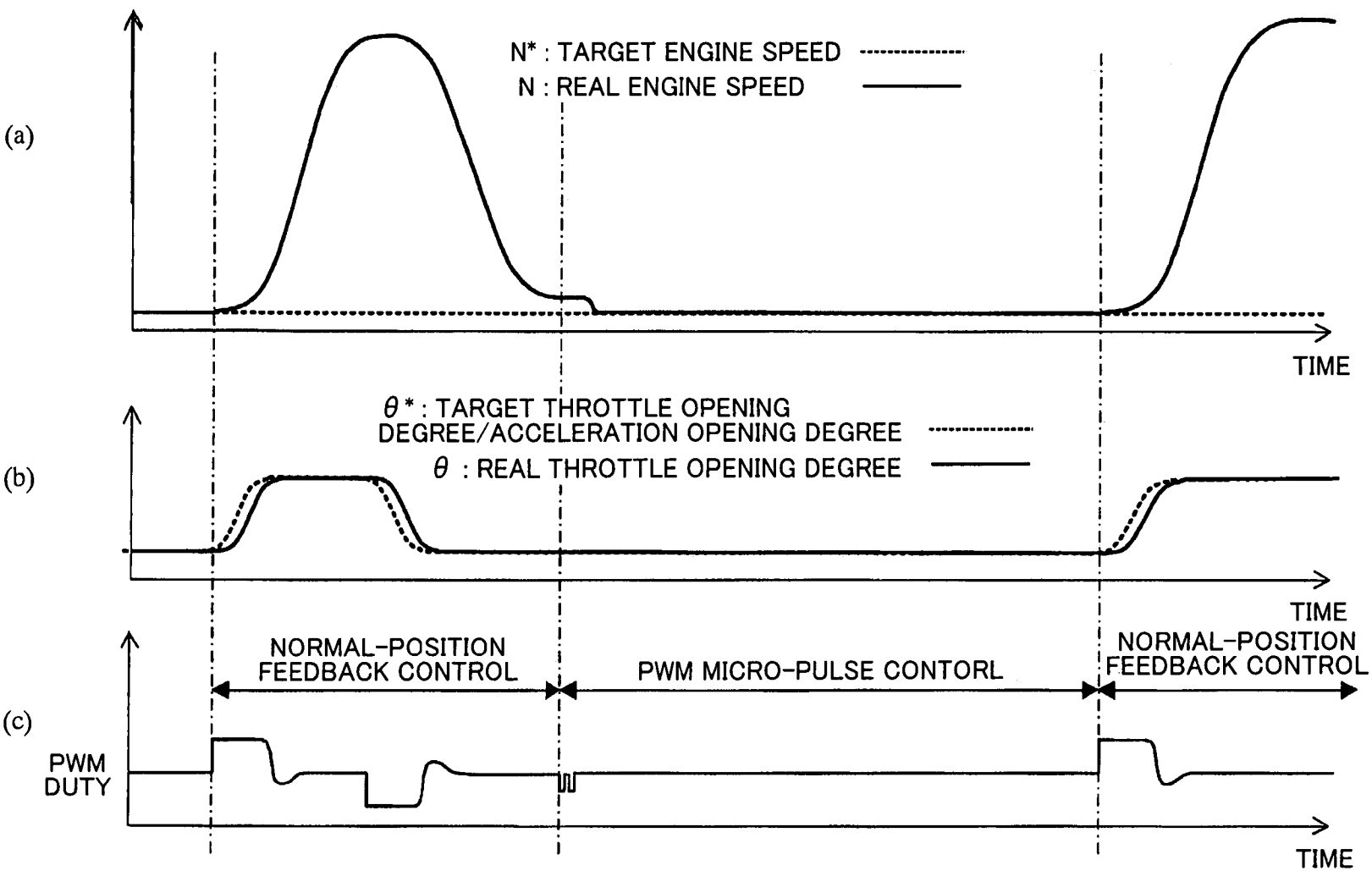
FIGS. 20(*a*), 20(*b*) and 20(*c*) are examples of a time chart at the time when a normal-time position feedback control and a PWM micro-pulse control are executed as switched from one to another, in which FIG. 20(*a*) shows the behaviors of a real engine speed and a target engine speed, FIG. 20(*b*) shows the behaviors of a real throttle opening degree and a target throttle opening degree, and FIG. 20(*c*) shows changes in PWM duty.

FIG. 20 shows an example of time charts in which the normal-time position feedback control and the PWM micro-pulse control are executed in combination with each other. FIG. 20(*a*) shows the behavior of the real engine speed N and the target engine speed N*. FIG. 20(*b*) shows the behavior of the real throttle opening degree θ and the target throttle opening degree θ*, and FIG. 20(*c*) shows changes in PWM duty.

When the real throttle opening degree is large, the normal-time position feedback control is executed such that the PWM duty is changed a large amount. On the other hand, when the real throttle opening degree is small and the target throttle opening degree is changed a small amount, the PWM micro-pulse control is executed. During this cycle, the PWM duty is changed in pulses.

Thus, depending on the situation, the PWM duty selecting unit 390 suitably selects a PWM duty generated by one of the PWM micro-pulse calculating unit 240*a*, the ISC position feedback control unit 330 and the normal-time position feedback control unit 340, and then supplies the selected PWM duty to the PWM signal generating unit 280. Accordingly, the engine speed is properly controlled by a control selected depending on the situation.

Figure 21:
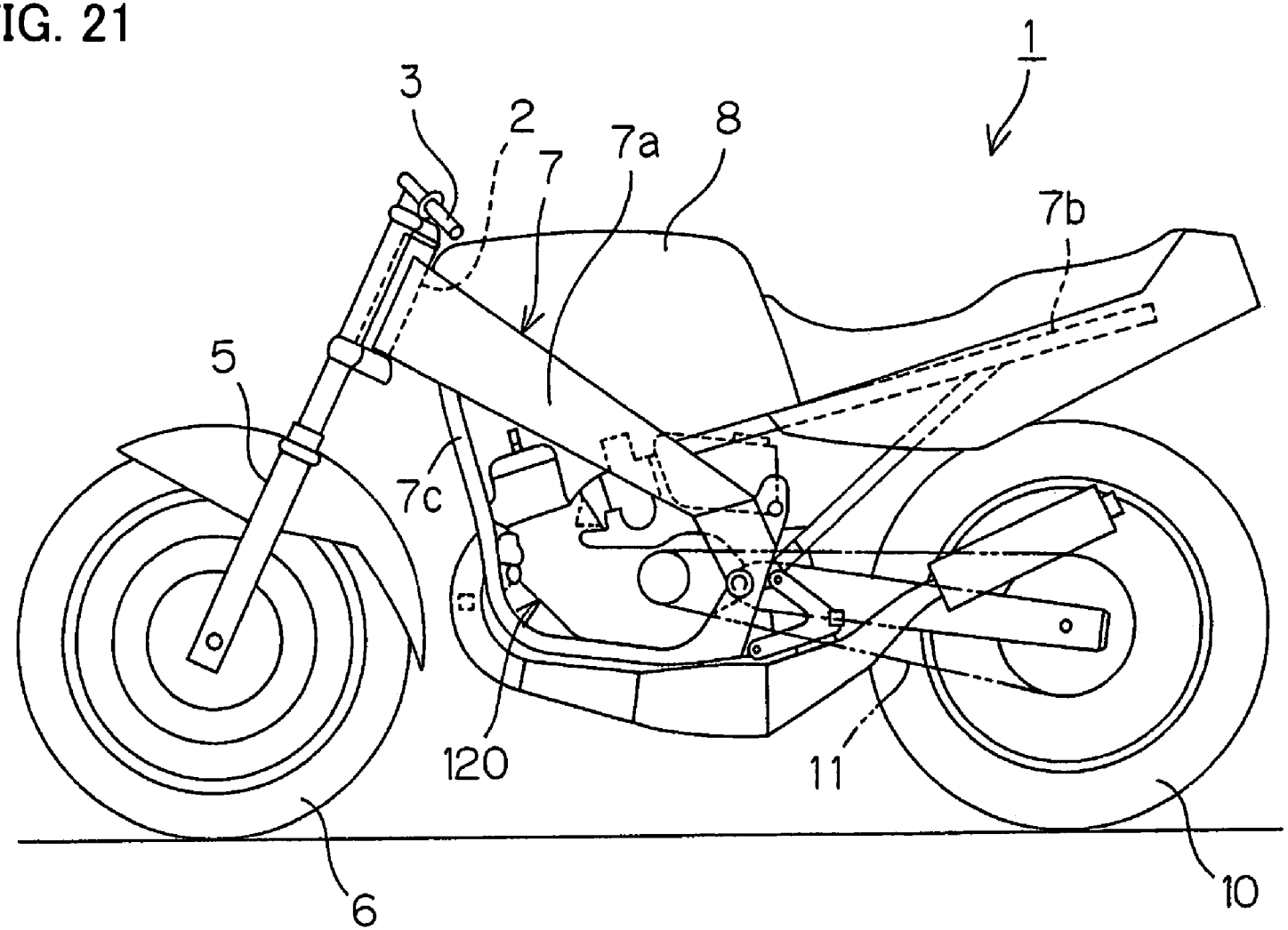
FIG. 21 is a view illustrating the arrangement of a two-wheeled vehicle as an example of a vehicle to which the above-mentioned engine systems can be applied.

FIG. 21 shows the arrangement of a two-wheeled vehicle as an example of a vehicle to which the engine system above-mentioned can be applied. A two-wheeled vehicle 1 includes a head pipe 2, a steering shaft rotationally supported by the head pipe 2, a handle 3 fixed to the upper end of the steering shaft, and a pair of front forks 5 connected to the lower portion of the steering shaft. A front wheel 6 is rotationally supported between the pair of front forks 5.

A frame 7 is connected to the head pipe 2. The frame 7 includes a pair of left and right main frames 7*a* of which front ends are fixed to the head pipe 2, a rear frame 7*b* extending rearward from the rear sides of the main frames 7*a*, and a down tube 7*c* connected to both the front sides of the main frames 7*a* and to the rear ends thereof as downwardly bent therebetween.

The front end of a swing arm 9 is rotationally supported by the main frames 7*a*. A rear wheel 10 is supported at the rear end of the swing arm 9.

An engine 120 is disposed between the main frames 7*a* and the down tube 7*c*. Disposed on the main frames 7*a* is a fuel tank 8 which stores fuel to be supplied to the engine 120.

The rotation force of the engine 120 is transmitted to the rear wheel 10 through a chain 11 or other suitable mechanism to rotate the rear wheel 10. Thus, the two-wheeled vehicle 1 can travel.

An accelerator grip (the accelerator 350 in FIG. 17) for controlling the output of the engine 120, is disposed at the right-hand end of the handle 3 (at the inner portion in FIG. 21), and the APS 360 (See FIG. 17) is disposed so as to be associated with this accelerator grip.

The engine speed control apparatus 100 or 100*a* (not shown in FIG. 21) is attached, for example, to the main frames 7*a*. When the speed of the engine 120 is controlled by the engine speed control apparatus 100, 100*a*, the engine speed is precisely controlled to assure a stable speed, particularly at the idle rotation time.

Figure 22:
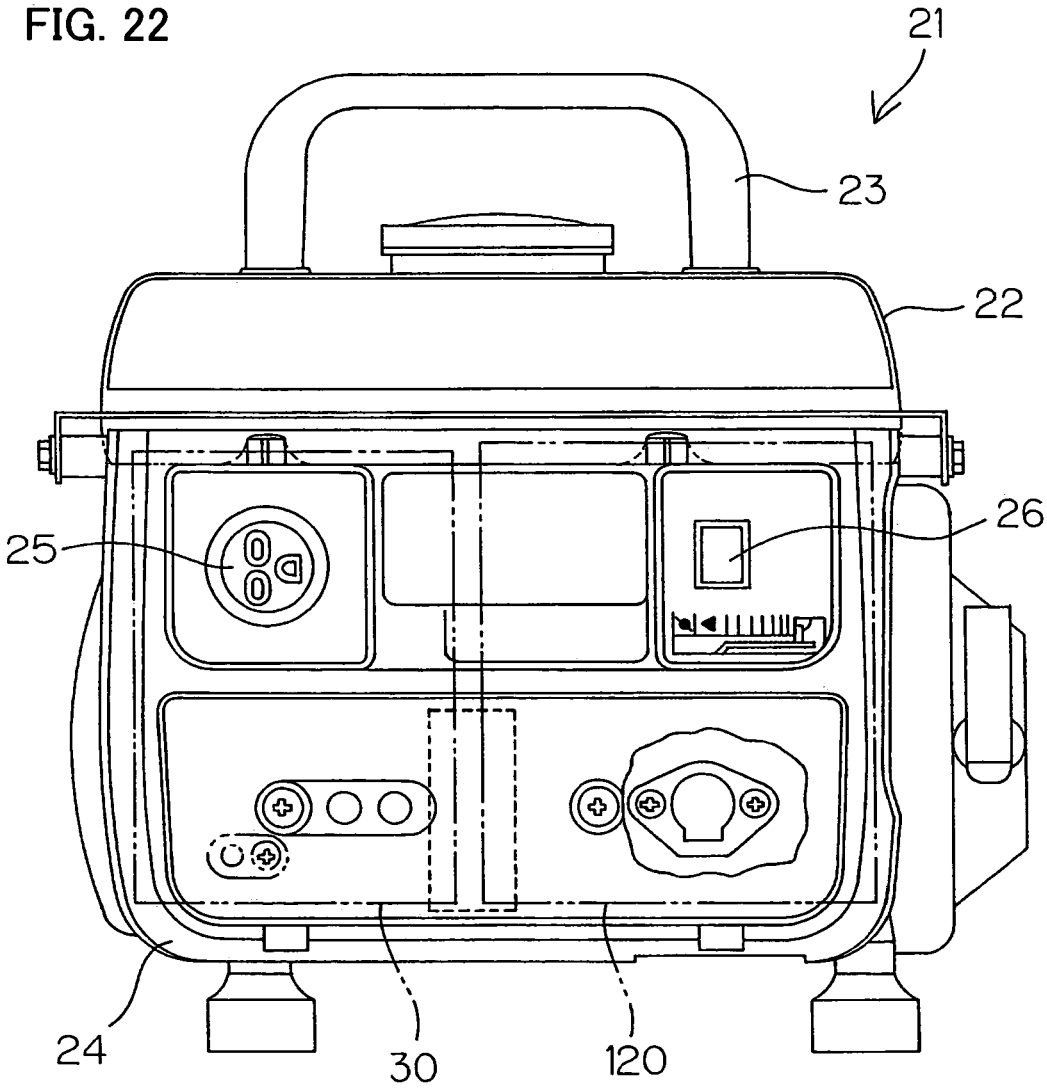
FIG. 22 is a front view of an engine generator to which the above-mentioned engine systems can be applied.

FIG. 22 is a front view of an engine generator to which the engine systems mentioned above can be applied. An engine generator 21 includes an engine 120 at the right-half portion in FIG. 22, and a generator unit 30 at the left-half portion in FIG. 22. Disposed on the engine generator 21 is a fuel tank 22 which stores fuel to be supplied to the engine 120. Further, a carrying handle 23 is attached.

Disposed at a frame 24 of the engine generator 21 are an electric outlet 25 for taking an electric power from the generator unit 30, and an engine switch 26. In this preferred embodiment, no accelerator lever is provided, but provision is made such that according to a load connected to the electric outlet 25, a target engine speed is set to control the engine speed.

The engine speed control apparatus 100, 100*a* for controlling the engine 120, is attached, for example, to the generator frame 24 (not shown in FIG. 22). By controlling the speed of the engine 120 by the engine speed control apparatus 100, 100*a*, the engine speed can be accurately controlled to the desired value with an economical arrangement. Thus, stable electric power is supplied.

Preferred embodiments of the present invention have been described above. However, the present invention may also be embodied in other forms. For example, in the preferred embodiments described above, an arrangement in which an ISCV is not used has been described. However, the present invention may also be applied to an engine system having an ISCV. Further, FIG. 21 shows a two-wheeled vehicle as an example of the vehicle, but the present invention may also be applied to a vehicle in other form such as a four-wheeled vehicle or a three-wheeled vehicle.

In the preferred embodiments described above, as the PWM control parameters, three types of parameters of PWM duty correction frequency $n_{pwm}$, PWM duty correction value Δduty and PWM duty correction value maintaining time $t_{pwm}$ are discussed, and the description has been made of the case in which all of the PWM control parameters can be changed. However, provision may be made such that the PWM micro-pulse control can be executed with only one or two parameters of these PWM control parameters being changed.

Preferred embodiments of the present invention have been described in detail, but these preferred embodiments are mere specific examples for clarifying the technical content of the present invention. Therefore, the present invention should not be construed as limited to these specific examples. The spirit and scope of the present invention are limited only by the appended claims.

This Application corresponds to Japanese Patent Application No. 2003-435017 filed with the Japanese Patent Office on 26 Dec. 2003, the full disclosure of which is incorporated herein by reference.

While the present invention has been described with respect to preferred embodiments, it will be apparent to those skilled in the art that the disclosed invention may be modified in numerous ways and may assume many embodiments other than those specifically set out and described above. Accordingly, it is intended by the appended claims to cover all modifications of the invention which fall within the true spirit and scope of the invention.

What is claimed is:

1. An engine speed control apparatus comprising:

a throttle valve arranged to adjust an amount of an intake air sucked into an engine;

a drive unit arranged to drive the throttle valve; and a control unit arranged to generate a PWM signal used to drive the drive unit;

the control unit including:

a real speed detecting unit arranged to detect a real engine speed;

a target speed setting unit arranged to set a target engine speed;

a target speed change amount calculating unit arranged to calculate a target engine speed change amount using the real engine speed detected by the real speed detecting unit and the target engine speed set by the target speed setting unit; and a PWM pulse generating unit arranged to calculate a PWM control parameter according to the target engine speed change amount calculated by the target speed change amount calculating unit, and generate a PWM signal based on the calculated PWM control parameter, so as to supply the generated PWM signal to the drive unit, the PWM control parameter including at least one of a PWM duty correction value for correcting a duty ratio of the PWM signal, a PWM duty correction value maintaining time during which the PWM duty correction value is continuously applied, and a PWM duty correction frequency at which the PWM duty correction value is applied.

2. An engine speed control apparatus according to claim 1, wherein an initial value of the PWM control parameter is set in the PWM pulse generating unit, and the initial value is set such that a minimal driving force required to exceed a static friction force which prevents the throttle valve from being displaced is provided to the throttle valve from the drive unit.

3. An engine speed control apparatus according to claim 1, wherein the PWM pulse generating unit is arranged to calculate the PWM control parameter as a function of the target engine speed change amount.

4. An engine speed control apparatus according to claim 1, wherein the PWM pulse generating unit is arranged to calculate the PWM control parameter as a function of the target engine speed change amount calculated by the target speed change amount calculating unit and the real engine speed detected by the real speed detecting unit.

5. An engine speed control apparatus according to claim 1, wherein the PWM pulse generating unit comprises:

a first control signal calculating unit that is arranged to calculate the PWM control parameter according to the target engine speed change amount calculated by the target speed change amount calculating unit, and is arranged to calculate, according to the calculated PWM control parameter, a first control signal used to PWM-control the drive unit; and a signal generating unit that is arranged to generate the PWM signal to be supplied to the drive unit;

the engine speed control apparatus further comprises:

a throttle opening degree detecting unit that is arranged to detect a throttle opening degree which is an opening degree of the throttle valve;

a target throttle opening degree change amount calculating unit that is arranged to calculate a target throttle opening degree change amount from the target engine speed change amount calculated by the target speed change amount calculating unit;

a target throttle opening degree calculating unit that is arranged to calculate a target throttle opening degree using the target throttle opening degree change amount and the real throttle opening degree detected by the throttle opening degree detecting unit;

a second control signal calculating unit that is arranged to calculate a second control signal used to PWM-control the drive unit such that the real throttle opening degree detected by the throttle opening degree detecting unit is brought close to the target throttle opening degree calculated by the target throttle opening degree calculating unit; and a selecting unit that is arranged to select one of the first control signal and the second control signal based on the target throttle opening degree change amount calculated by the target throttle opening degree change amount calculating unit, and is arranged to supply the selected first or second control signal to the signal generating unit; wherein the signal generating unit is arranged to generate the PWM signal based on the control signal supplied from the selecting unit.

6. An engine speed control apparatus according to claim 5, wherein the selecting unit is arranged to select and supply the first control signal to the signal generating unit when the target throttle opening degree change amount calculated by the target throttle opening degree change amount calculating unit is not greater than a selection judgment value previously determined based on an input resolution of the throttle opening degree detecting unit, and the selecting unit is arranged to select and supply the second control signal to the signal generating unit when the target throttle opening degree change amount calculated by the target throttle opening degree change amount calculating unit is greater than the selection judgment value.

7. An engine speed control apparatus according to claim 5, further comprising:

an accelerator tracking target throttle opening degree calculating unit that is arranged to calculate a target throttle opening degree based on an accelerator opening degree; and a third control signal calculating unit that is arranged to calculate a third control signal used to PWM-control the drive unit such that the real throttle opening degree detected by the throttle opening degree detecting unit is brought close to the target throttle opening degree calculated by the accelerator tracking target throttle opening degree calculating unit; and the selecting unit is arranged to select one of the first control signal, the second control signal and the third control signal based on the real throttle opening degree detected by the throttle opening degree detecting unit and the target throttle opening degree change amount calculated by the target throttle opening degree change amount calculating unit, and is arranged to supply the control signal thus selected to the signal generating unit.

8. An engine speed control apparatus according to claim 7, wherein the selecting unit is arranged to select and supply the third control signal when the real throttle opening degree detected by the throttle opening degree detecting unit is greater than a predetermined threshold, and the selecting unit is arranged to select and supply one of the first control signal, the second control signal and the third control signal according to the target throttle opening degree change amount calculated by the target throttle opening degree change amount calculating unit when the real throttle opening degree is not greater than the threshold.

9. An engine speed control apparatus according to claim 1, wherein the PWM pulse generating unit is arranged to repeatedly execute, at desired time intervals, a PWM correction control in which a PWM signal corresponding to the PWM control parameter is supplied to the drive unit, and the engine speed control apparatus further comprises:

a real speed change amount calculating unit arranged to calculate a real engine speed change amount using the real engine speed detected by the real speed detecting unit before a PWM correction control and the real engine speed detected by the real speed detecting unit after the PWM correction control; and a changing unit that is arranged to use the target engine speed change amount calculated by the target speed change amount calculating unit and the real engine speed change amount calculated by the real speed change amount calculating unit to change the relationship between the target engine speed change amount and the PWM control parameter for subsequent PWM correction controls.

10. An engine speed control apparatus according to claim 9, wherein the changing unit is arranged to change the relationship of the PWM duty correction value with respect to the target engine speed change amount when the absolute value of the real engine speed change amount calculated by the real speed change amount calculating unit is substantially zero.

11. An engine speed control apparatus according to claim 9, wherein the changing unit is arranged to change the relationship of the PWM duty correction value maintaining time or the PWM duty correction frequency with respect to the target engine speed change amount when the absolute value of the real engine speed change amount calculated by the real speed change amount calculating unit is not substantially zero but the difference between the absolute value of the real engine speed change amount and the absolute value of the target engine speed change amount calculated by the target speed change amount calculating unit exceeds a predetermined threshold.

12. An engine system comprising:

an engine;

a throttle valve arranged to adjust the amount of an intake air sucked into the engine;

a drive unit arranged to drive the throttle valve; and a control unit arranged to generate a PWM signal used to drive the drive unit;

the control unit including:

a real speed detecting unit arranged to detect a real engine speed;

a target speed setting unit arranged to set a target engine speed;

a target speed change amount calculating unit arranged to calculate a target engine speed change amount using the real engine speed detected by the real speed detecting unit and the target engine speed set by the target speed setting unit; and a PWM pulse generating unit that is arranged to calculate a PWM control parameter according to the target engine speed change amount calculated by the target speed change amount calculating unit, and generate a PWM signal based on the calculated PWM control parameter so as to supply the generated PWM signal to the drive unit, the PWM control parameter including at least one of a PWM duty correction value used to correct a duty ratio of the PWM signal, a PWM duty correction value maintaining time during which the PWM duty correction value is continuously applied, and a PWM duty correction frequency at which the PWM duty correction value is repeatedly applied.

13. A vehicle comprising:

an engine;

a wheel arranged to be rotationally driven by a drive force generated by the engine;

a throttle valve arranged to adjust the amount of an intake air sucked into the engine;

a drive unit arranged to drive the throttle valve; and a control unit arranged to generate a PWM signal used to drive the drive unit;

the control unit including:

a real speed detecting unit arranged to detect a real engine speed;

a target speed setting unit arranged to set a target engine speed;

a target speed change amount calculating unit arranged to calculate a target engine speed change amount using the real engine speed detected by the real speed detecting unit and the target engine speed set by the target speed setting unit; and a PWM pulse generating unit arranged to calculate a PWM control parameter, according to the target engine speed change amount calculated by the target speed change amount calculating unit, and generate a PWM signal based on the calculated PWM control parameter, so as to supply the generated PWM signal to the drive unit, the PWM control parameter including at least one of a PWM duty correction value used to correct a duty ratio of the PWM signal, a PWM duty correction value maintaining time during which the PWM duty correction value is continuously applied, and a PWM duty correction frequency at which the PWM duty correction value is repeatedly applied.

14. An engine generator comprising:

a generating unit;

an engine defining a drive source and arranged to operate the generating unit;

a throttle valve arranged to adjust the amount of an intake air sucked into the engine;

a drive unit arranged to drive the throttle valve; and a control unit arranged to generate a PWM signal used to drive the drive unit;

the control unit including:

a real speed detecting unit arranged to detect a real engine speed;

a target speed setting unit arranged to set a target engine speed;

a target speed change amount calculating unit arranged to calculate a target engine speed change amount using the real engine speed detected by the real speed detecting unit and the target engine speed set by the target speed setting unit; and a PWM pulse generating unit arranged to calculate a PWM control parameter, according to the target engine speed change amount calculated by the target speed change amount calculating unit, and generate a PWM signal based on the calculated PWM control parameter, so as to supply the generated PWM signal to the drive unit, the PWM control parameter including at least one of a PWM duty correction value used to correct a duty ratio of the PWM signal, a PWM duty correction value maintaining time during which the PWM duty correction value is continuously applied, and a PWM duty correction frequency at which the PWM duty correction value is repeatedly applied.

15. An engine speed control method for driving a throttle valve by a drive unit driven by a PWM signal to control the speed of an engine, the method comprising:

a real speed detecting step of detecting a real engine speed;

a target speed setting step of setting a target engine speed;

a target speed change amount calculating step of calculating a target engine speed change amount based on the detected real engine speed and the set target engine speed;

a PWM control parameter calculating step of calculating a PWM control parameter according to the calculated target engine speed change amount, the PWM control parameter including at least one of a PWM duty correction value used to correct the duty ratio of the PWM signal, a PWM duty correction value maintaining time during which the PWM duty correction value is continuously applied, and a PWM duty correction frequency at which the PWM duty correction value is applied; and a PWM signal supplying step of generating a PWM signal based on the calculated PWM control parameter and supplying the PWM signal thus generated to the drive unit.

16. An engine speed control method according to claim 15, further comprising a step of setting the initial value of the PWM control parameter such that a minimum driving force required to exceed a static friction force which prevents the throttle valve from being displaced is supplied to the throttle valve from the drive unit.

17. An engine speed control method according to claim 15, wherein the PWM control parameter calculating step includes a step of determining a PWM control parameter based on the target engine speed change amount and the real engine speed.

18. An engine speed control method according to claim 15, wherein the method further comprises:

a step of generating a first control signal based on the calculated PWM control parameter;

a throttle opening degree detecting step of detecting, by a throttle opening degree detecting unit, a real throttle opening degree which is an opening degree of the throttle valve;

a target throttle opening degree calculating step of calculating a target throttle opening degree using the target engine speed change amount and the detected real throttle opening degree; and a step of calculating a second control signal for PWM-controlling the drive unit such that the real throttle opening degree is brought close to the target throttle opening degree; and the PWM signal supplying step includes:

a control signal selecting step of selecting one of the first control signal and the second control signal; and a step of generating a PWM signal based on the selected control signal and supplying the generated PWM signal to the drive unit.

19. An engine speed control method according to claim 18, wherein the control signal selecting step includes:

a step of selecting the first control signal when the target throttle opening degree change amount, corresponding to the target engine speed change amount, is not greater than a selection judgment value previously determined based on an input resolution of the throttle opening degree detecting unit; and a step of selecting the second control signal when the target throttle opening degree change amount is greater than the selection judgment value.

20. An engine speed control method according to claim 15, further comprising:

a real speed change amount calculating step of calculating a real engine speed change amount using the real engine speed detected before and after a PWM correction control in which a PWM signal corresponding to the PWM control parameter is supplied to the drive unit; and a step of changing, with the use of both the target engine speed change amount and the real engine speed change amount, the relationship between the target engine speed change amount and the PWM control parameter for subsequent PWM correction controls that follow.

* * * * *